US009518484B2

(12) United States Patent
Watanabe et al.

(10) Patent No.: US 9,518,484 B2
(45) Date of Patent: Dec. 13, 2016

(54) VARIABLE DISPLACEMENT PUMP

(71) Applicant: HITACHI AUTOMOTIVE SYSTEMS, LTD., Hitachinaka-shi, Ibaraki (JP)

(72) Inventors: Yasushi Watanabe, Kanagawa (JP); Hideaki Ohnishi, Atsugi (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 124 days.

(21) Appl. No.: 14/319,597

(22) Filed: Jun. 30, 2014

(65) Prior Publication Data

US 2015/0020759 A1 Jan. 22, 2015

(30) Foreign Application Priority Data

Jul. 17, 2013 (JP) ..... 2013-148098

(51) Int. Cl.

| | |
|---|---|
| ***F01L 1/34*** | (2006.01) |
| ***F01L 1/344*** | (2006.01) |
| ***F04C 2/344*** | (2006.01) |
| ***F04C 14/22*** | (2006.01) |

(52) U.S. Cl.

CPC ..... *F01L 1/3442* (2013.01); *F04C 2/3442* (2013.01); *F04C 14/226* (2013.01); *F01L 2001/3445* (2013.01); *F01L 2001/34423* (2013.01)

(58) Field of Classification Search

CPC ..... F04C 14/226; F01L 2001/34423

See application file for complete search history.

(56) References Cited

U.S. PATENT DOCUMENTS

| | | | | |
|---|---|---|---|---|
| 4,902,209 | A * | 2/1990 | Olson | F01C 20/22 123/240 |
| 5,030,074 | A | 7/1991 | Sakamaki et al. | |
| 8,613,610 | B2 | 12/2013 | Saga et al. | |
| 2008/0308062 | A1 * | 12/2008 | Morita | F04C 14/226 123/196 R |

(Continued)

FOREIGN PATENT DOCUMENTS

| | | | | |
|---|---|---|---|---|
| DE | 102009039776 | A1 * | 3/2011 | F01M 1/02 |
| JP | 2011-111926 | A | 6/2011 | |

OTHER PUBLICATIONS

U.S. Appl. No. 14/516,938, filed Oct. 17, 2014, Hitachi Automotive Systems, Ltd.

(Continued)

*Primary Examiner* — Thomas Denion
*Assistant Examiner* — Daniel Bernstein
(74) *Attorney, Agent, or Firm* — Foley & Lardner LLP

(57) ABSTRACT

A variable displacement pump includes an urging mechanism to urge a cam ring in an eccentric direction and to increase the urging force when an eccentricity is decreased, a first control chamber to apply a force to the cam ring in a direction decreasing the eccentricity, and a second control chamber to apply a force, to the cam ring, in a direction increasing the eccentricity. The variable displacement pump further includes a thermosensitive mechanism to control the supply and drain of a discharge pressure supplied into the second control chamber, and a control valve to be operated by the discharge pressure and to decrease the pressure in the second control chamber when the discharge pressure increases.

18 Claims, 16 Drawing Sheets

(56) References Cited

U.S. PATENT DOCUMENTS

| | | | | |
|---|---|---|---|---|
| 2010/0028171 | A1* | 2/2010 | Shulver | F01M 1/16 417/307 |
| 2010/0221126 | A1* | 9/2010 | Tanasuca | F04C 14/226 417/218 |
| 2010/0282204 | A1* | 11/2010 | Zwickler | F04C 2/3442 123/196 R |
| 2011/0123379 | A1* | 5/2011 | Saga | F04C 2/3442 418/26 |
| 2011/0194967 | A1* | 8/2011 | Watanabe | F04C 14/226 418/138 |
| 2012/0051955 | A1 | 3/2012 | Hadar | |
| 2012/0301342 | A1* | 11/2012 | Ohnishi | F04C 14/223 418/25 |
| 2013/0136641 | A1* | 5/2013 | Novi | F01M 1/02 418/26 |
| 2014/0234150 | A1 | 8/2014 | Sugihara et al. | |
| 2015/0240808 | A1 | 8/2015 | Akatsuka et al. | |
| 2016/0047280 | A1 | 2/2016 | Armenio et al. | |

OTHER PUBLICATIONS

SAGA: US Notice of Allowance on U.S. Appl. No. 14/516938 dated Sep. 27, 2016.

* cited by examiner

VARIABLE DISPLACEMENT PUMP

BACKGROUND OF THE INVENTION

The present invention relates to a variable displacement pump and more specifically to a variable displacement pump which can be used for an internal combustion engine, to supply an oil to various sliding contact portions, for example.

Recently, oil discharged from an oil pump is used, in addition to lubrication for sliding contact portions of an engine, for various other purposes requiring different discharge pressure levels; for example, a driving source for variable valve actuation apparatus, an oil jet for cooling pistons and for lubrication of bearings supporting a crankshaft. Accordingly, there are demands for oil pumps providing desirable changeover between a low pressure characteristic and a high pressure characteristic in a low rotational speed region, and a high pressure characteristic in a high rotational speed region. To meet these demands, a variable displacement pump is proposed in a patent document 1, JP2011-111926 (≈US 2011/0123379A1)

In the variable displacement pump disclosed in this patent document, a cam ring is urged by two spring members provided with different spring loads, to achieve a lower pressure characteristic and a high pressure characteristic mechanically without using an electric control device.

SUMMARY OF THE INVENTION

The variable displacement pump of the patent document 1 is designed to improve fuel consumption by decreasing the discharge oil quantity and oil pressure to reduce energy consumption in a low and medium engine speed region having greater influence on the fuel consumption. However, in the low and medium engine speed region, even if the engine oil temperature is increased, it is unfeasible or difficult to achieve an oil pressure required for the piston cooling oil jet.

If the oil pressure in the low and medium speed region is set at a relatively high level required for the oil jet, the oil may be injected from the oil jet at a normal oil temperature requiring no oil jet, resulting in useless consumption of the oil quantity and driving power.

Therefore, it is an object of the present invention to provide a variable displacement pump adequate for various situations, and more specifically to provide a variable displacement pump adequate for reducing energy consumption by decreasing a discharge oil pressure in a normally used oil temperature state in a low and medium engine speed region and for improving reliability by increasing the discharge oil pressure in a higher oil temperature state, to enable the operation of the piston cooling oil jet.

According to one aspect of the present invention, a variable displacement pump for an internal combustion engine, comprises: a rotor adapted to be driven by the internal combustion engine; a plurality of vanes slidably received in an outer circumference of the rotor; a cam ring which surrounds the rotor and the vanes, which has a center line eccentric from a rotation axis of the rotor, which defines a plurality of operating oil chambers, and which is arranged to move to vary an eccentricity and thereby to vary a pump volume; an intake portion formed to open into the operating oil chambers in a volume increasing region in which volumes of the operating oil chambers are increased with rotation of the rotor; a discharge portion formed to open into the operating oil chambers in a volume decreasing region in which the volumes of the operating oil chambers are decreased with rotation of the rotor; an urging mechanism including at least one spring member (or first and second spring members), and arranged to apply an urging force to the cam ring in an eccentric direction with a spring force produced by the at least one spring member; a first control chamber arranged to receive an oil discharged from the discharge portion and to apply a force to the cam ring in a direction decreasing the eccentricity; a second control chamber arranged to receive the oil discharged from the discharge portion and to apply a force smaller than the force produced by the first control chamber, to the cam ring in a direction increasing the eccentricity; a thermosensitive mechanism to connect the second control chamber with the discharge portion in a higher oil temperature state and to connect the second control chamber with a low pressure portion in a low oil temperature state; and a control valve to be operated by a discharge pressure of the discharge portion and to decrease a pressure in the second control chamber when the discharge pressure of the discharge portion becomes higher than or equal to a predetermined pressure.

DETAILED DESCRIPTION OF THE INVENTION

FIGS. 1~19 show variable displacement pumps according to embodiments of the present invention. In the illustrated examples, the present invention is applied to a variable displacement pump to be used for serving as a driving source of a valve timing control apparatus for varying opening/closing timing(s) of engine valve(s) of an internal combustion engine for a motor vehicle, for supplying lubricating oil to various portions of the internal combustion engine, specifically for supplying the lubricating oil to sliding portion between a piston and a cylinder bore through an oil jet, and for supplying the lubricating oil to bearings for a crankshaft.

First Embodiment

Figure 1:
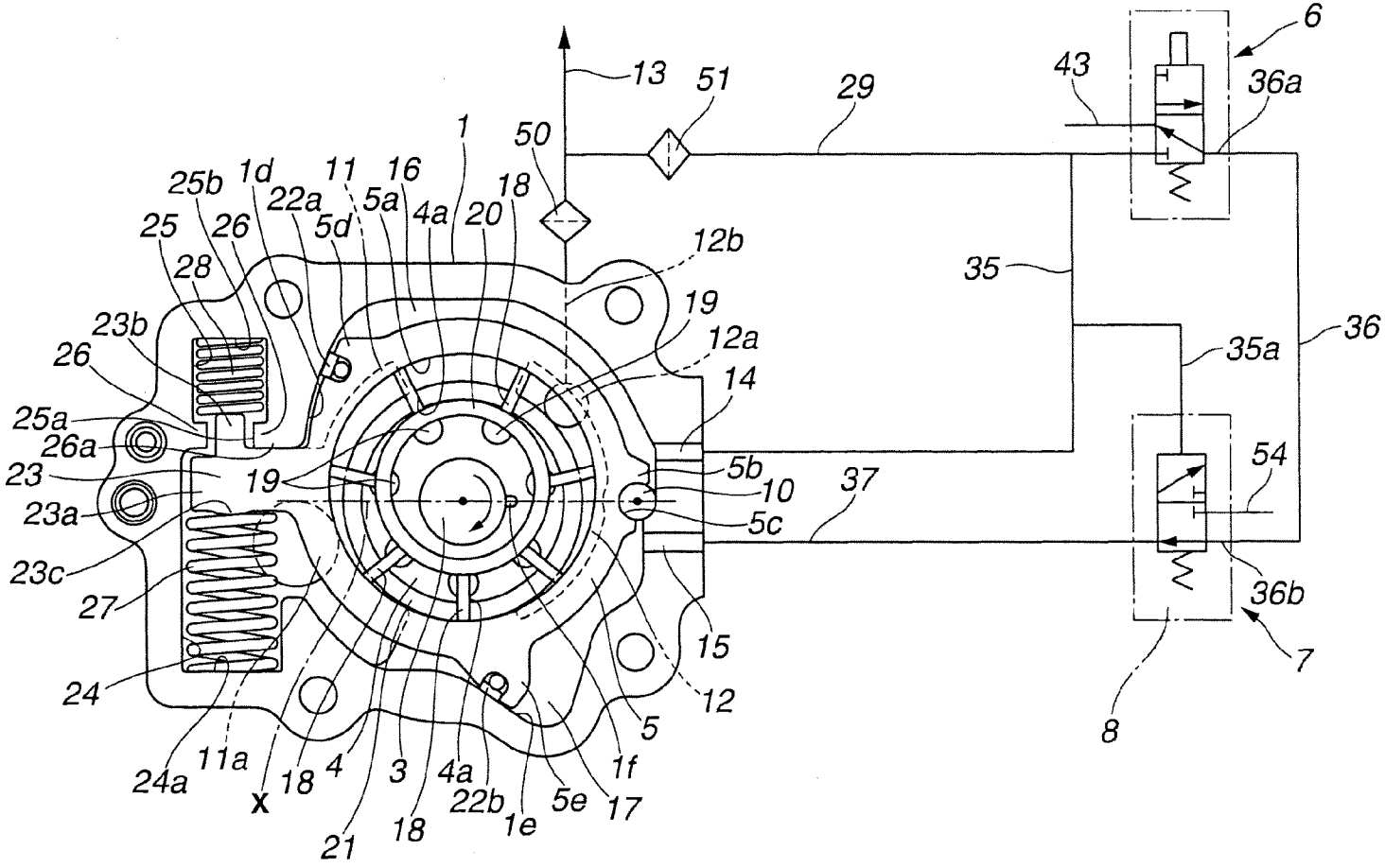
FIG. 1 is a schematic view showing a variable displacement pump according to a first embodiment.
Figure 2:
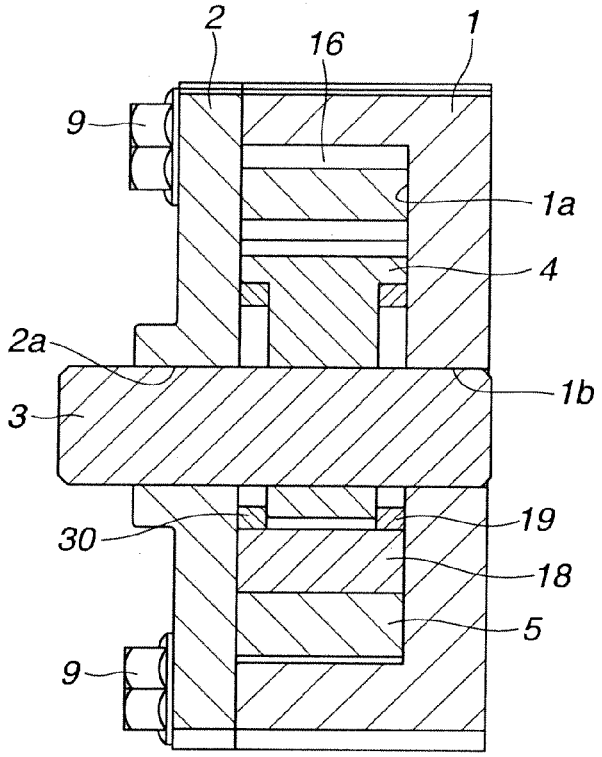
FIG. 2 is a vertical sectional view showing a pump main body of the variable displacement pump of FIG. 1.

A variable displacement pump according to the first embodiment is a vane type pump main body adapted to be installed at a front end portion of a cylinder block of an internal combustion engine, for example. As shown in FIGS. 1 and 2, the variable displacement pump mainly includes: a pump housing 1 having a bottom wall at one end and an open end at the opposite end; a pump cover 2 closing the open end of pump housing 1; a drive shaft 3 which passes through a center portion of pump housing 1 and which is adapted to be driven by a crankshaft of the internal combustion engine; a rotor 4; and a cam ring 5 serving as a movable member. The rotor 4 is received rotatably in pump housing 1, mounted on and connected with the drive shaft 3, and shaped to have an approximately I-shaped cross section. The cam ring 5 is an annular member which surrounds rotor 4 and which is arranged to swing.

There are further provided a thermosensitive valve 6 and a pilot valve 7 (control valve) which are provided in a control housing 8 of an aluminum alloy fixed to outer side surface of pump cover 2. The thermosensitive valve or temperature sensing valve 6 serves as a main component of a thermosensitive or temperature sensing mechanism or device for controlling the supply and drain of an oil pressure to a second control oil chamber 17 serving as a second control chamber as mentioned later, in accordance with the oil temperature of the engine. The pilot valve 7 serves as a control valve for controlling the changeover of the supply and drain of the oil flowing from the thermosensitive valve 6, to the second control oil chamber 17, in accordance with a pump discharge pressure from the pump main body.

The pump housing 1 and pump cover 2 are joined together to form a housing unit by a plurality of bolts 9, as shown in FIG. 2. In this example, four of the bolts 9 are inserted through bolt holes formed in pump housing 1 and pump cover 2, and tightened, respectively, into female screw holes formed in the cylinder block at the time of installing the pump to the cylinder block.

Pump housing 1 is a single integral member of an aluminum alloy including the end wall or bottom wall including a bottom surface 1*a*, and a circumferential wall forming a recess bounded axially by the bottom surface 1*a*. The cam ring 5 in the recess abuts axially on the bottom surface 1*a* and slides on bottom surface 1*a*. Therefore, the bottom surface 1*a* is formed and finished accurately by a machining operation to increase a precision in flatness and surface roughness in a sliding contact area.

Figure 3:
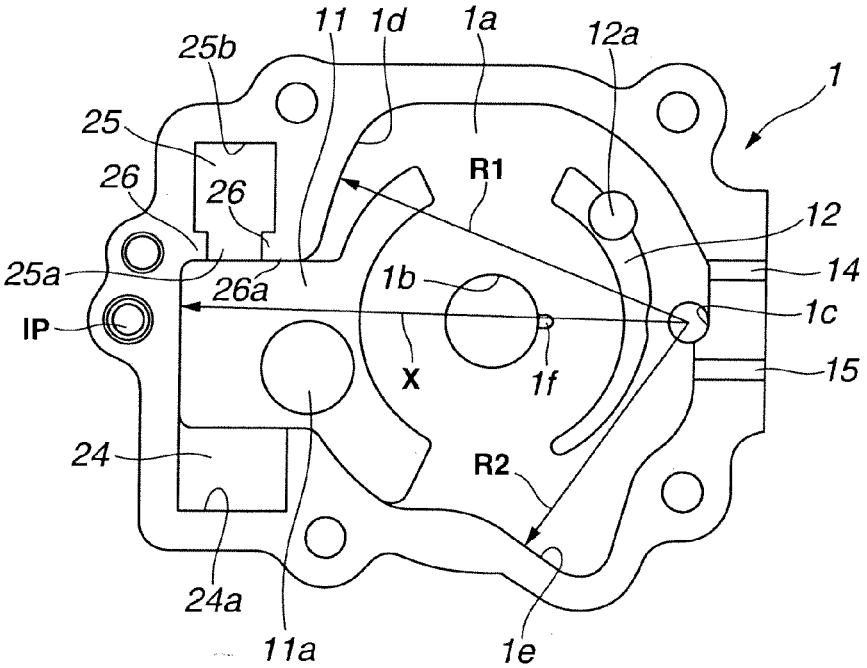
FIG. 3 is a front view of a pump housing of the variable displacement pump of FIG. 1.

Pump housing 1 includes a center shaft hole 1*b* extending though the end wall at a central region, to receive the drive shaft 3, and a pin hole 1*c* in the form of a blind hole, at a predetermined position spaced radially from the center shaft hole 1*b*, as shown in FIG. 3. The pin hole 1*c* is arranged to extend axially in the axial direction of the center shaft hole 1*b*, and to receive a pivot pin 10 as explained later.

Pump housing 1 includes first and second seal surfaces 1*d* and 1*e*, respectively, on opposite sides (upper and lower sides as viewed in FIG. 3) of an imaginary straight line X (hereinafter referred to as a cam ring reference line) connecting the axis of the pivot pin 10 (or the pin hole 1*c*) and the center of the center shaft hole 1*b* of pump housing 1 (the axis of drive shaft 3). Each of the first and second seal surfaces 1*d* and 1*e* is an inside circumferential surface curved in the form of a circular arc.

First and second seal surfaces 1*d* and 1*e* are, respectively, in the form of a circular arc having a predetermined radius R1 around the axis of the pin hole 1*c*, and a circular arc having a predetermined radius R2 around the axis of the pin hole 1*c*, as shown in FIG. 3.

A first control fluid chamber or oil chamber 16 serving as a first control chamber is sealed and defined, in cooperation with the outside circumferential surface of cam ring 5, by a first seal member 22*a* sliding on the first seal surface 1*d* as shown in FIG. 1.

A second control fluid chamber or oil chamber 17 serving as a second control chamber is sealed and defined, in cooperation with the outside circumferential surface of cam ring 5, by a second seal member 22*b* sliding on the second seal surface 1*e* as shown in FIG. 1.

An intake or inlet port 11 and a discharge or outlet port 12 are formed in the bottom surface 1*a* of pump housing. As shown in FIG. 3, the intake port 11 is shaped like a crescent, and formed on a first side (left side in FIG. 3) of the drive shaft 3 (the center shaft hole 1*b* is located between the intake port 11 and the pin hole 1*c*). The discharge port 12 is also shaped like a crescent, and formed on a second side (right side in FIG. 3) of the drive shaft 3 (the discharge port 12 is located between the center shaft hole 1*b* and the pin hole 1*c*). The intake and discharge ports 11 and 12 confront each other diametrically.

As shown in FIGS. 1 and 3, the intake port 11 is in fluid communication with an intake hole 11*a* for receiving the lubricating oil from an oil pan (not shown). The discharge port 12 is in fluid communication with a discharge hole 12*a* for delivering the lubricating oil through a main oil gallery 13, for example to various sliding contact portions, to a valve timing control apparatus or valve actuation apparatus, and to bearings for the crankshaft.

A branch passage 29 branches off from the main oil gallery 13, and leads to thermosensitive valve 6 and pilot valve 7.

A first oil filter 50 is provided between a discharge passage 12*b* extending from the discharge hole 12*a* and the main oil gallery 13. A second oil filter 51 is provided in the branch passage 29 at a position near the branch point at which the branch passage 29 branches off from main oil gallery 13. Therefore, the oil supplied to the pilot valve 7 and thermosensitive valve 6 is filtered twice by first and second oil filters 50 and 51. These oil filters 50 and 51 are of a type, such as a cartridge type, including a replaceable filtering element, such as a filter paper, which can be replaced when clogged, by a new one.

A lubricating oil groove 1*f* is formed in the inside circumferential surface of center shaft hole 1*b* opened approximately at the center of bottom wall surface 1*a*, as shown in FIGS. 1 and 3, and arranged to retain the lubricating oil for lubricating the drive shaft 3.

First and second communication holes 14 and 15 are formed in pump housing 1 at upper and lower positions above and below the pin hole 1*c*, as shown in FIGS. 1 and 3, and connected, respectively with the first control oil chamber 16 and second control oil chamber 17.

The pump cover 2 is an integral member made of an aluminum alloy material, and includes a flat inside surface and a center shaft hole 2*a* opened through the pump cover 2 and arranged to receive the drive shaft 3 and to support drive shaft 3 in cooperation with the center shaft hole 1*b* of pump housing 1. It is possible to form the intake hole, the discharge hole and an oil reserving portion in the flat inside surface of pump cover 2, as in the bottom surface 1*a* of pump housing 1. Pump cover 2 is positioned in the circumferential direction with respect to pump housing 1 with a plurality of positioning pins IP, and fastened to pump housing 1 with the bolts 9.

Drive shaft 3 is arranged to rotate the rotor 4 in the clockwise direction in FIG. 1, with a rotational force transmitted from the crankshaft. An intake region is formed in a left half on the left side of drive shaft 3 as viewed in FIG. 1, and an discharge region is formed in a right half on the right side of drive shaft 3.

A plurality (seven) of vanes 18 are slidably received, respectively, in a plurality (seven) of radial slits 4*a* formed radially in rotor 4 to extend radially outwards. A back pressure chamber 19 is formed at the radial inner end of each slit 4*a*. In this example, each back pressure chamber 19 has an approximately circular cross section. The back pressure chambers 19 are arranged to receive the discharge oil pressure discharged to discharge port 12.

Each vane 18 includes an inner base end sliding on an outer circumferential surface of a pair of vane rings 20, 20 and a forward end sliding on an inside circumferential surface 5*a* of the cam ring 5. A plurality of pumping chambers 21 serving as operating oil chambers are formed by the vanes 18, the inside circumferential surface 5*a* of cam ring 5, the outside circumferential surface of rotor 4, the bottom surface 1*a* of pump housing 1, and the inside surface of pump cover 2. Each vane ring 20 rotates eccentrically with rotation of drive shaft 3, and thereby pushes each vane 18 radially outwards.

Cam ring 5 is an integral member shaped like a hollow cylinder, and made of easily-machined sintered metallic material. Cam ring 5 includes a pivot projection 5*b* formed in the outside circumferential surface on the cam ring reference line X at a right outer position as viewed in FIG. 1. At the center of this pivot projection 5*b*, there is formed a pivot groove 5*c* which is recessed in the form of a circular arc, which extends axially, and which is arranged to receive the pivot pin 10 inserted and positioned in pivot hole 1*c*, to determine a fulcrum of eccentric swing motion.

First and second projections 5*d* and 5*e* are approximately triangular projections formed in cam ring 5. The first projection 5*d* is formed on the upper side of the cam ring reference line X whereas the second projection 5*e* is on the lower side of the cam ring reference line X.

The first and second seal members 22*a* and 22*b* are made of low-friction synthetic resin material, for example, shaped to extend in the axial direction of cam ring 5, and retained, respectively, in retaining grooves formed in the first and second projections 5*d* and 5*e* of cam ring 5. First and second seal members 22*a* and 22*b* are biased forward and pressed against the seal surface 1*d* and 1*e*, respectively, by the elastic forces of respective elastic members of rubber fixed on the bottoms of the above-mentioned retaining grooves. Thus, the seal member 22*a* and 22*b* always seal the first and second control oil chambers 16 and 17 liquid-tightly.

The first control oil chamber 16 is a relatively long chamber having an approximately crescent shape defined between the first seal member 22*a* and the pivot pin 10 along the outside circumference surface of cam ring 5. The first control oil chamber 16 function to swing the cam ring 5 about pivot pin 10 in the counterclockwise direction in FIG. 1 with the discharge oil pressure introduced from discharge port 12, and thereby to move the cam ring 5 in the direction decreasing the eccentricity or eccentricity quantity with respect to rotation axis of rotor 4.

The second control oil chamber 17 is a relatively short chamber having a shape different from the shape of first control oil chamber 16, defined between the second seal member 22*a* and the pivot pin 10 along the outside circumference surface of cam ring 5. The second control oil chamber 17 function to swing the cam ring 5 about pivot pin 10 in the clockwise direction in FIG. 1 with the discharge oil pressure introduced, through the thermosensitive valve 6 and pilot valve 7, from discharge port 12, and thereby to move the cam ring 5 in the direction increasing the eccentricity with respect to rotor 4.

First oil chamber 16 and second control oil chamber 17 are formed in the above-mentioned respective ranges. Therefore, the pressure receiving area in the outside surface of cam ring 5 receiving the oil pressure in first control oil chamber 16 is greater than the pressure receiving area in the outside surface of cam ring 5 receiving the oil pressure in second control oil chamber 17.

An arm 23 is an integral part of cam ring 5, projecting from the outside circumferential surface of cam ring 5, at a position diametrically opposite to the position of pivot projection 5*b*. As shown in FIGS. 1, 5 and 6, the arm 23 projects, in the form of a rectangular plate, radially from the outside end of cam ring 5, and includes a forward end 23*a*, a projection or upper projection 23*b* projecting integrally from the upper side of arm 23 at a position near the forward end 23*a*, and a raised portion or lower projection 23*c* projecting integrally in the form of a projection raised in a form like a circular arc from the lower surface of arm 23, at the position opposite to or just below the upper projection 23*b*.

The (upper) projection 23*b* projects, in the form of an approximately long flat rectangular shape as shown in FIG. 1, substantially in a direction (upward direction) perpendicular to a longitudinal direction of the arm 23*a* and includes an upper end curved to have a relatively small radius of curvature.

First and second spring chambers 24 and 25 are formed on upper and lower sides of arm 23 on the side opposite to pivot hole 1*c* of pump housing 1. In FIGS. 1 and 3, the first spring chamber 24 is on the lower side of arm 23, and the second spring chamber 25 is located on the upper side of arm 23 to confront the first spring chamber 24 coaxially across arm 23.

First spring chamber 24 is shaped like a flat rectangular shape extending in an axial direction of pump housing 1 or downward direction and connected to the intake hole 11*a* serving as a low pressure portion. Second spring chamber 25 is shorter in the dimension in the up and down direction than first spring chamber 24. Like first spring chamber 24, the second spring chamber 25 is shaped like a flat rectangular shape extending in the axial direction of pump housing 1. A lower open end 25*a* of second spring chamber 25 is defined by a pair of retaining portions 26, 26 projecting toward each other in the form resembling a (long) rectangle in the direction of the width of second spring chamber 25. Through the open end 25*a* between the retaining portions 26, 26, the (upper) projection 23*b* of arm 23 can move into and out of the second spring chamber 25. The retaining portions 26, 26 are arranged to regulate a maximum expansion deformation of a later-mentioned second coil spring 28.

A first coil spring 27 is disposed in first spring chamber 24, and arranged to serve as an urging or biasing member for urging the cam ring 5 through arm 23 in the clockwise direction in FIG. 1.

First coil spring 27 includes a lower end abutting elastically on a bottom surface 24*a* of first spring chamber 24, and an upper end always abutting elastically on the raised portion or lower projection 23*c* formed on the lower side of arm 23 so that a predetermined spring set load W1 is imparted beforehand. Thus, the first spring 27 urges the cam ring 5 in the direction increasing the eccentricity with respect to the rotation axis of rotor 4. In this way, first coil spring 27 is disposed under compression so as to apply an urging force to cam ring 5 in the clockwise direction.

The second coil spring 28 is disposed in second spring chamber 25, and arranged to serve as an urging or biasing member for urging the cam ring 5 through arm 23 in the counterclockwise direction in FIG. 1.

Second coil spring 28 includes an upper end abutting elastically on an upper inside surface 25*b* of second spring chamber 25, and a lower end abutting elastically on the upper projection 23*b* of arm 23, and thereby urging the cam ring 5 in the counterclockwise direction to decrease the eccentricity with respect to the rotation axis of rotor 4 during movement from the maximum eccentricity position of cam ring 5 in the clockwise direction to the position stopped by the retaining portions 26, 26.

Second coil spring 28, too is endowed with a predetermined spring set load W2 counteracting first coil spring 27. The set load W2 is smaller than the set load W1 of first coil spring 27. Cam ring 5 is set at an initial position (maximum eccentricity position) by the difference between the loads W1 and W2 of first and second coil springs 27 and 28.

In this example, the first coil spring 27 always urges the cam ring 5 in the state provided with the spring set load W1, through arm 23 upwards in the direction to produce the eccentricity, that is, in the direction increasing the volumes of pumping chambers 21. The spring set load W1 is set at a value at which the cam ring 5 starts moving at the oil pressure equaling a required oil pressure P1 required by the valve timing control apparatus.

Figure 7:
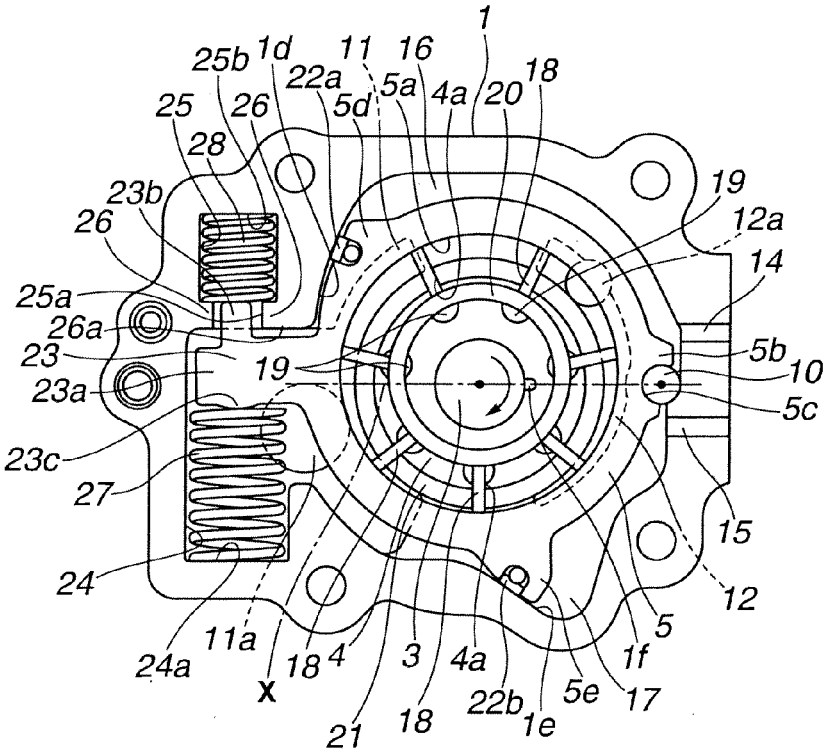
FIG. 7 is a view of the pump main body in a state in which the cam ring is further rotated in the counterclockwise direction.
Figure 8:
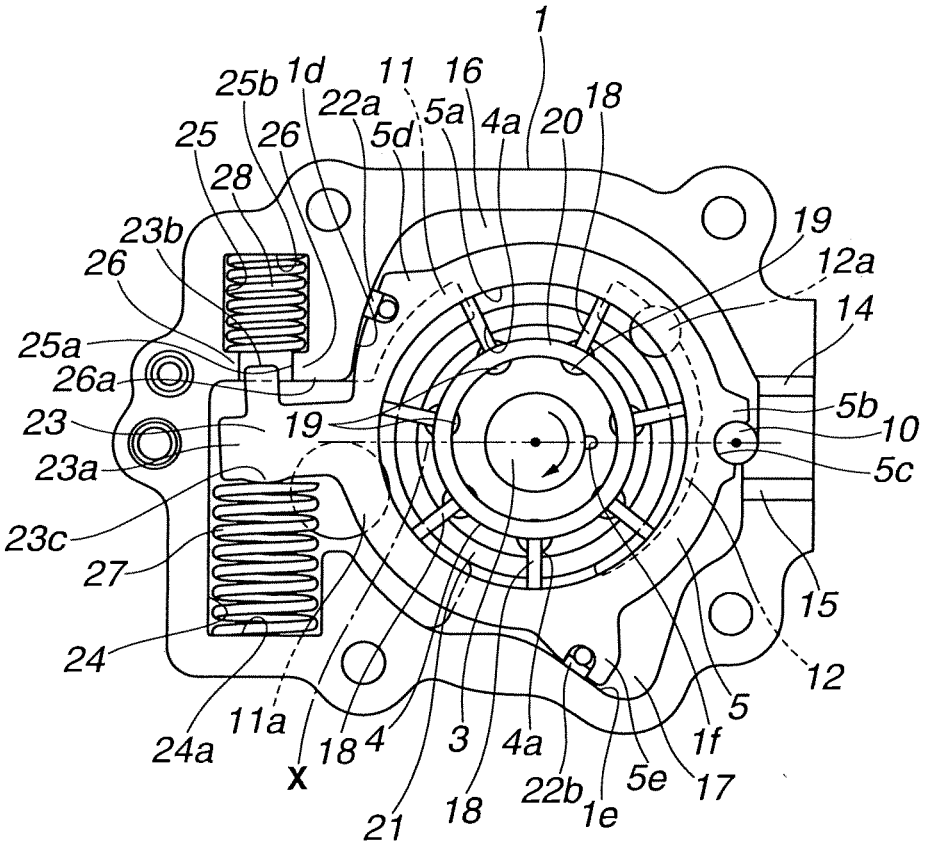
FIG. 8 is a view of the pump main body in a state in which the cam ring is further rotated in the counterclockwise direction.

On the other hand, the second coil spring 28 is arranged to abut on the arm 23 elastically when the eccentricity of cam ring 5 between the rotation center of rotor 4 and the center of the inside circumferential surface of cam ring 5 is greater than or equal to a predetermined value. However, when the eccentricity of cam ring 5 between the rotation center of rotor 4 and the center of the inside circumferential surface of cam ring 5 becomes smaller than the predetermined value, the second coil spring 28 is held compressed by the retaining portions 26, 26, as shown in FIGS. 7 and 8, and held in a state in which second spring 28 slightly touches or does not touch the arm 23 at all.

Figure 10:
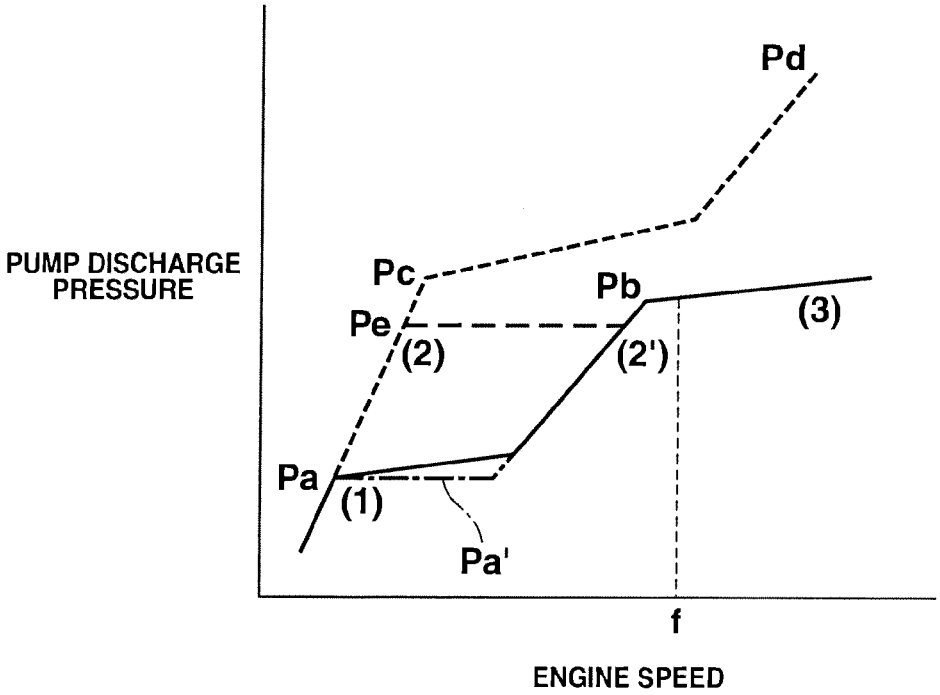
FIG. 10 is a graphic view showing a relationship between a discharge oil pressure and an engine speed in the first embodiment.

The spring set load W1 of first coil spring 27 at a swing quantity (a quantity of swing motion) of cam ring 5 at which the load applied on arm 23 by second coil spring 28 is made equal to zero by the retaining portions 26, 26 is a load at which the cam ring 5 starts moving, as shown in FIG. 10, when the oil pressure is equal to a required pressure (2') for the oil jet for the pistons, or a required oil pressure (3) required for the bearings of the crank shaft at the time of a maximum crankshaft rotational speed.

The first coil spring 27 and second coil spring 28 constitute an urging or biasing mechanism.

Figure 9:
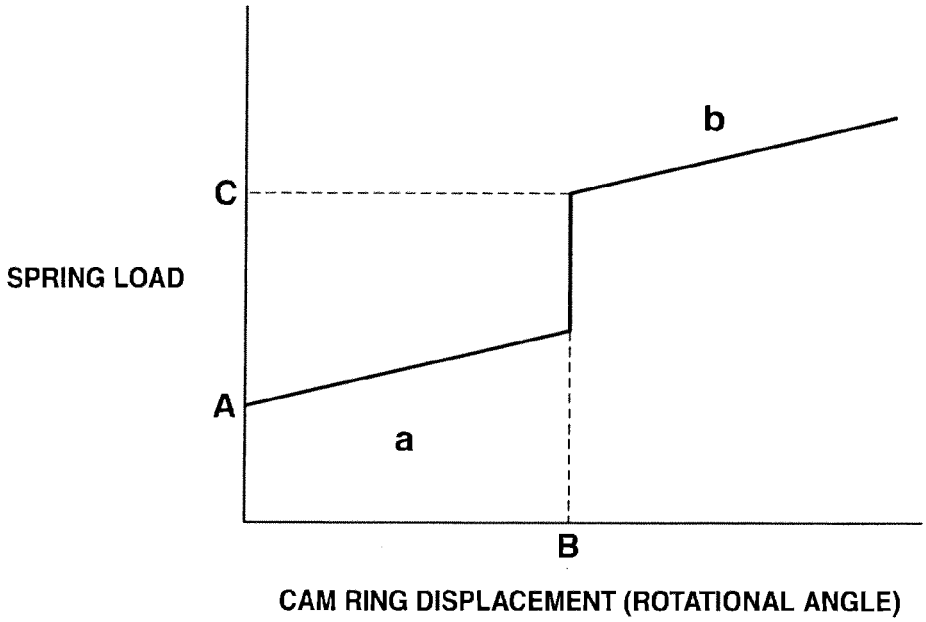
FIG. 9 is a graphic view showing a relationship between a spring load and a cam ring displacement in the first embodiment.

FIG. 9 shows a relationship between the angular displacement of cam ring 5 and the spring loads of first and second coil springs 27 and 28. Even when the angular displacement of cam ring 5 is equal to zero (at the maximum eccentricity position), the spring set load A of the coil springs 27 and 28 is provided. In a range "a" of the angular displacement of cam ring 5, the spring set load W2 of second coil spring 28 acts as an assist force, and hence the cam ring 5 can rotate in the counterclockwise direction in FIG. 1 with a small load. The slope of the spring load corresponds to a spring constant.

When cam ring 5 rotates to a position B in FIG. 9, the lower end of second coil spring 28 abuts on the retaining portions 26, 26 and hence the assist force becomes unobtainable. Therefore, cam ring 5 becomes unable to rotate in the same direction. When the spring load becomes greater than or equal to C, that is, when the supply pressure to first control chamber 16 increases and becomes higher than the spring load of first coil spring 27, the cam ring 5 becomes rotatable again against this spring load, into a region "b".

A varying mechanism is constituted by the cam ring 5, vane rings 20 and 20, the first and second control oil chambers 16 and 17 and the first and second coil spring 27 and 28.

The branch passage 29 extends through an intermediate point connected with the first communication hole 14 leading to first control oil chamber 16 through a (first) communication passage 35, to a downstream end connected with the thermosensitive valve 6, which is connected, through a (connection) passage 36, with the pilot valve 8. A supply/drain passage or second communication passage 37 extends from a first end connected with pilot valve 7 to a second end connected with second communication hole 15 leading to second control oil chamber 17.

Figure 4B:
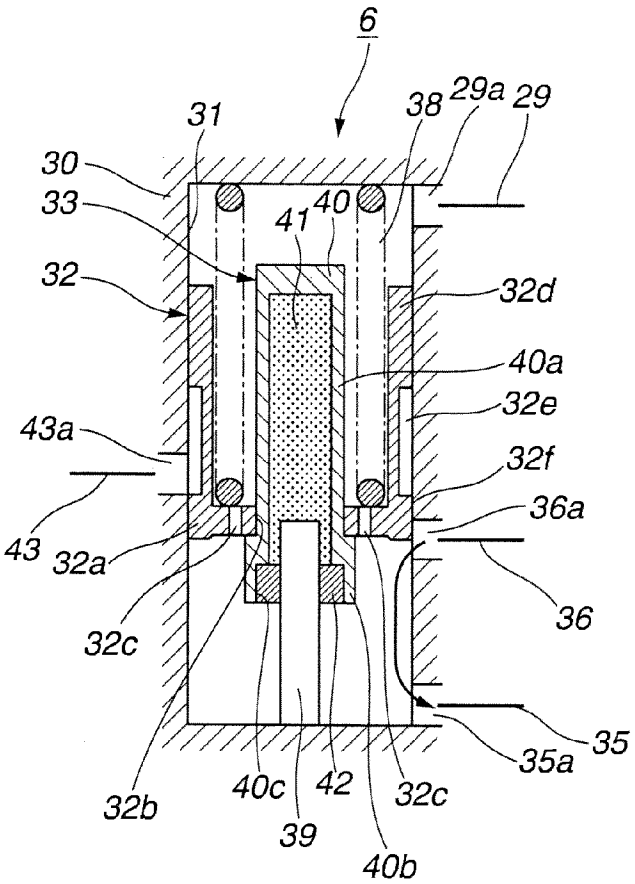
FIGS. 4A and 4B are vertical sectional views showing a thermosensitive valve employed in the variable displacement pump of FIG. 1, respectively, in a low oil temperature state in which the engine oil temperature is lower than or equal to a predetermined temperature, and a high oil temperature state in which the engine oil temperature is higher than the predetermined temperature.
Figure 4A:
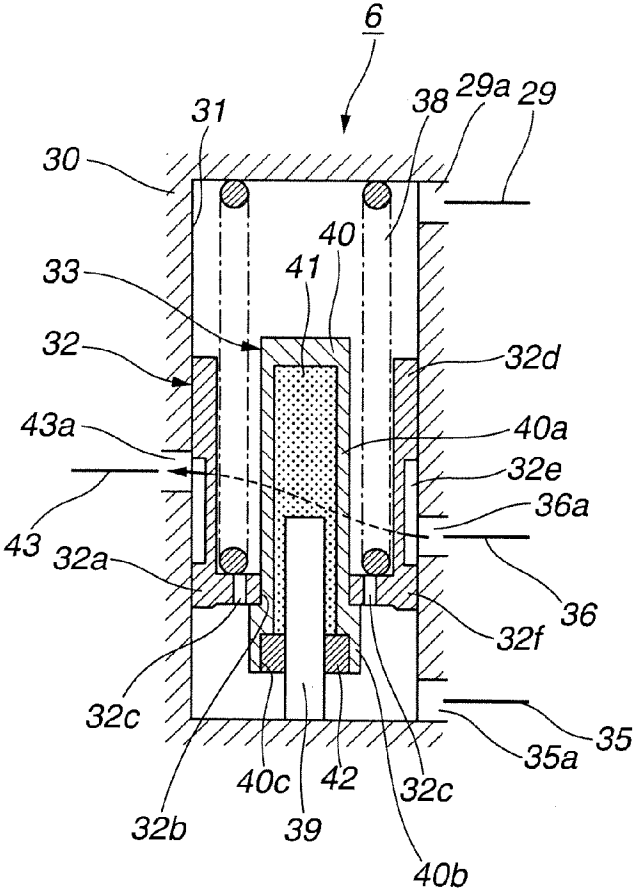

As shown in FIGS. 4A and 4B, the thermosensitive valve 6 includes a cylinder block 30 including therein a cylinder bore 31 extending in the up and down direction as viewed in the figures, a valve member 32 slidable in the cylinder bore 31, and a thermosensitive member 33 disposed in valve member 32 and arranged to actuate valve member 32 in accordance with the oil temperature of the oil introduced into cylinder bore 31.

A first end 29*a* of branch passage 29 is opened into the cylinder bore 31 of thermosensitive valve 6 at an upper position near the upper end of cylinder bore 31. An upstream end 35*a* of first communication passage 35 leading to first control oil chamber 16 is opened into cylinder bore 31 near the lower end of cylinder bore 31. At an intermediate position in the longitudinal direction of cylinder bore 31 between the upper and lower ends, an open end 36*a* of the connection oil passage 36 connecting thermosensitive valve 6 with pilot valve 7 is opened. At a position on the opposite side opposite to this open end 36*a*, higher than the position of this open end 36*a*, there is formed an open end 43*a* of a drain port 43 for draining the oil to the outside (an oil pan), and serving as the low pressure portion.

The valve member 32 is shaped like a hollow cylinder closed at one end, and includes a bottom wall or end wall 32*a* and a circumferential wall 32*d*. Valve member 32 includes a center through hole 32*b* having a relatively large diameter, formed at a center of bottom wall 32*a*, through bottom wall 32*a* in an axial direction. Valve member 32 further includes a plurality of passage holes 32*c* extending in the axial direction through bottom wall 32*a*, around the center through hole 32*b*. Valve member 32 further includes an annular groove 32*e* formed in the outside surface of circumferential wall 32*d* at a position closer to bottom wall 32*a*. This annular groove 32*e* can connect the open end 36*a* of connection oil passage 36 and open end 43*a* of drain port 43 in dependence on the slide position of valve element 32.

Valve member 32 includes a valve portion 32*f* formed in circumferential wall 32*d* at or near the bottom wall 32*a* and arranged to connect the open end 36*a* of connection oil passage 36 with the upstream end 35*a* of first communication passage 35 when valve member 32 moves upwards to a predetermined position.

A valve spring 38 is disposed in the cylinder bore 31 and arranged to urge the valve member 32 downwards in FIG. 4A, toward the position to connect the open end 36*a* of connection oil passage 36 with the open end 43*a* of drain passage 43 through thermosensitive member 33.

The thermosensitive member 33 mainly includes a guide rod 39, a drive portion 40 and wax pellets 41 filled in the drive portion 40. The guide rod 39 is a small diameter circular column projecting upwards from the center of the bottom of cylinder bore 31. The drive portion 40 is fit over the guide rod 39 so that drive portion 40 can slide up and down along guide rod 39.

Guide rod 39 is made of metallic material, and has a length approximately equal to one third of the total length of cylinder bore 31 in the axial direction.

The drive portion 40 is an integral member shaped like a hollow cylinder closed at one end, and includes a cylindrical portion 40*a* slidably fit in a slide hole 32*b* of valve member 32, and a stopper portion 40*b* projecting radially outwards like a flange, from the lower end of cylindrical portion 40*a*, to have a diameter greater than the diameter of cylindrical portion 40*a*. An annular groove 40*c* is formed in the inside circumferential surface of stopper portion 40*b* at the lower end. A seal member 42 is press fit in the annular groove 40*c*. The inside circumferential surface of this seal member 42 is in sliding contact with the outside circumferential surface of guide rod 39 in a liquid tight manner.

The cylindrical portion 40*a* has the inside cavity filled with wax pellets 41, and sealed liquid-tightly by the seal member 42. The stopper portion 40*b* has an upper end surface on which an inside circumferential portion of the bottom wall 32*a* of valve member 32 abuts elastically in the state in which valve member 32 is urged downwards by spring 38. The inside circumferential portion of bottom wall 32*a* is a portion surrounding the center through hole 32*b* and surrounded by the passage holes 32*c*.

The branch passage 29 is always held in communication with the first communication passage 35 through the open end 29*a* opening into the upper portion of cylinder bore 31, the passage holes 32*c* formed through the bottom wall 32*a* of valve member 32, and the open end 35*a* opening into the lower portion of cylinder bore 31. With this arrangement, the discharge fluid pressure is supplied to first control fluid chamber 16 from the first communication passage 35 through the first communication hole 14.

The drive portion 40 is arranged to hold the valve member 32 at a lower position shown in FIG. 4A through cylindrical portion 40*a* by the shrinkage of wax pellets 41 in a lower oil temperature state. In this lower position, the open end 36*a* of connection fluid passage 36 is connected through the annular groove 32*e* of valve member 32, with the open end 43*a* of drain port 43, as shown in FIG. 4A.

When the oil temperature increases gradually and becomes high, the wax pellets 41 expand gradually and causes an upward force to act to the cylindrical portion 40*a*. Therefore, the drive portion 40 moves upwards along the guide rod 39 against the resilient force of valve spring 38, as shown in FIG. 4B. At the same time, the valve member 32 moves upwards through the stopper portion 40*b* to a predetermined upper position. At this upper position of valve member 32, the valve portion 32*f* shuts off the communication between the open end 36*a* of connection fluid passage 36 and the open end 43*a* of drain port 43, and connects the connection fluid passage 36 and the first communication passage 35 through the lower portion of cylinder bore 31. The opening size or opening area of the open end 36*a* is increased gradually and continuously by the valve portion 32*f* with the upward movement of valve member 32.

Figure 5B:
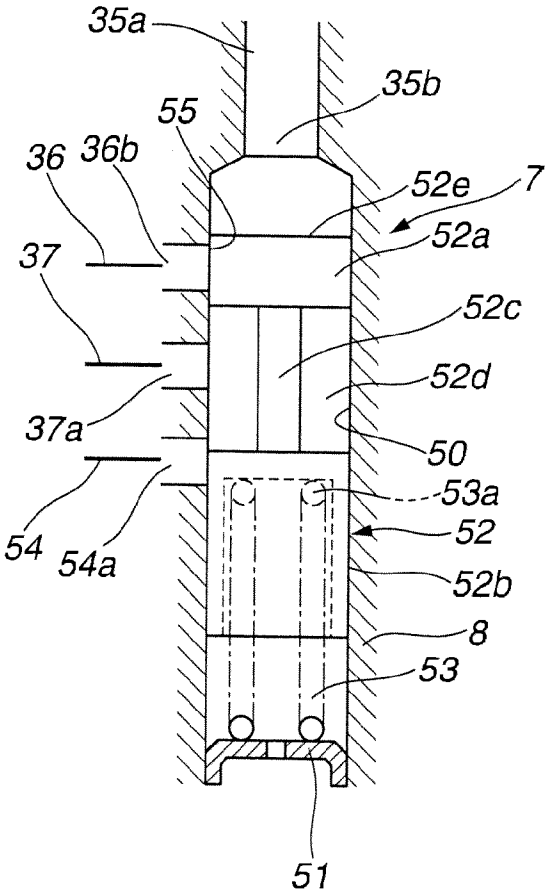
FIGS. 5A and 5B are vertical sectional views showing a pilot valve employed in the variable displacement pump of FIG. 1, respectively, in a low discharge pressure operating state in which a pump discharge pressure is lower than or equal to a predetermined level, and a high discharge pressure operating state in which the pump discharge pressure is higher than the predetermined level.
Figure 5A:
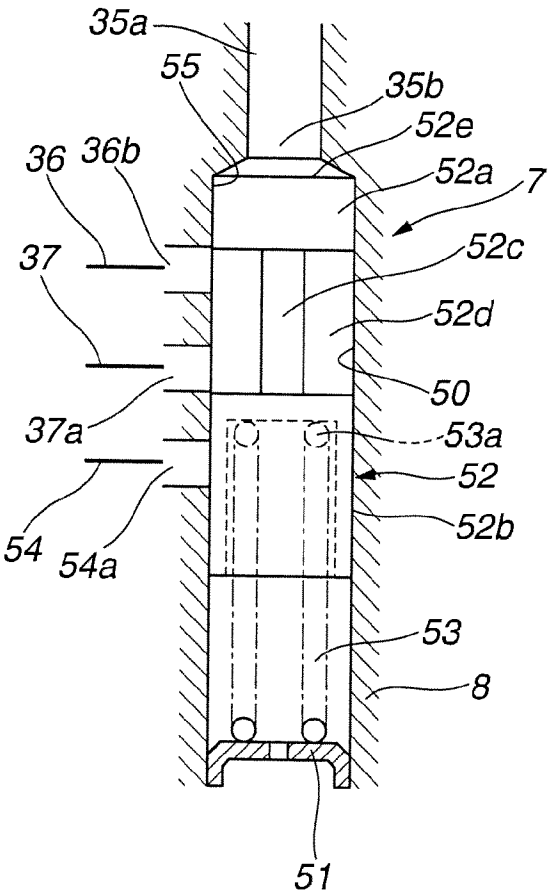
Figure 6:
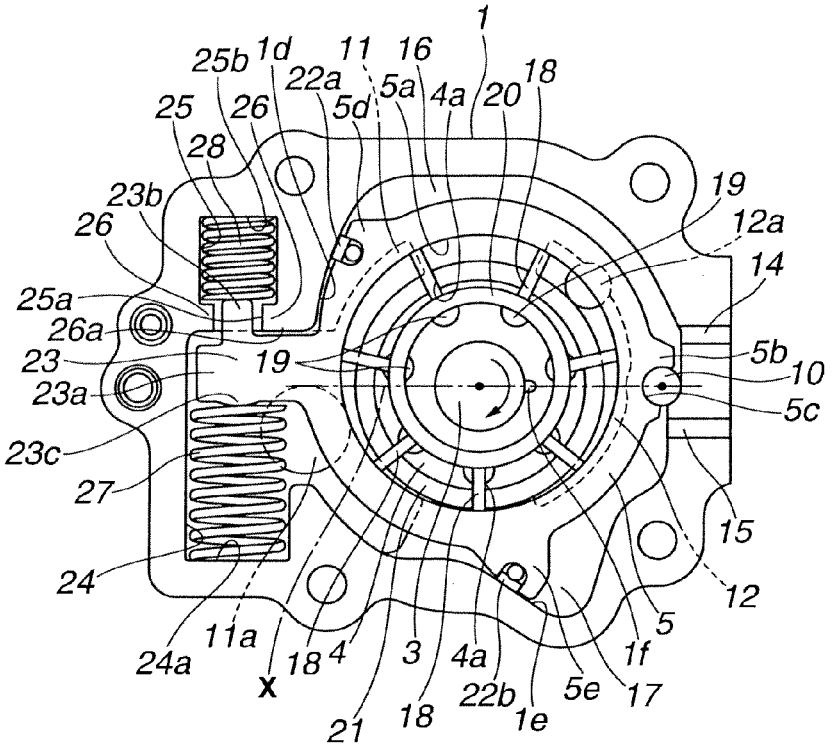
FIG. 6 is a view showing the pump main body, to illustrate operation of the variable displacement pump of FIG. 1, in a state in which a cam ring is rotated in a counterclockwise direction against a first coil spring.

As shown in FIGS. 5A and 5B, the pilot valve 7 includes a spool 52 slidable in an up and down direction in a cylindrical slide hole 50, and a valve spring 53. The slide hole 50 is provided in the up and down direction in the control housing 8. A lower open end of the slide hole 50 is closed by an end member 51. The valve spring 53 is disposed between the spool 52 and the end member 51, and arranged to urge spool 52 upwards toward an upper position to close an open end 35*b* of the branch portion 35*a* of the first communication passage 35 opening at the upper portion of slide hole 50.

The slide hole 50 is defined by the upper end in which the open end 35*b* of branch portion 35*a* is opened and the circumferential wall surface formed with three openings. The first opening of the circumferential wall surface of slide hole 50 is an open end 36*b* of connection fluid passage 36, located at a higher position near the upper end of slide hole 50. The second opening is an open end 37*a* of the supply/drain (second communication) passage 37, located at a middle position below the open end 36*b*. The third opening is an open end 54*a* of the drain port 54 leading to the oil pan. The open end 54*a* is located at a lower position below the open end 37*a*.

The open end 35*b* of first communication passage 35 is smaller in the cross sectional size or the inside diameter than the slide hole 50. Between the smaller open end 35*b* and the larger slide hole 50, there is formed a tapered seat portion 55. A first land 52*a* of spool 52 abuts on the seat portion 55 and moves away from the seat portion 55, as explained below.

The spool 52 includes the first land 52*a* serving as the valve element, on the upper side, a second land 52*b* on the lower side and a shaft portion 52*c* having a smaller sectional size and extending between the first land 52*a* on the upper side and the second land 52*b* on the lower side.

First land 52*a* closes the open end 35*b* of passage 35 in the state in which first land 52*a* is seated on the seat portion 36*b* by the spring force of valve spring 53. At the same time, the open end 36*b* of passage 36 is connected with the open end 37*a* of supply/drain passage 37 through an annular space or annular groove 52*d* formed around the shaft portion 52*c*.

Second land 52*b* is shaped like a hollow cylinder closed at one end (the upper end), and arranged to receive an upper part of the valve spring 53 and to support an upper end 53*a* of valve spring 53 with the inside upper end surface. In dependence on the slide position of spool 52 in the up and down direction, the second land 52*b* shuts off the communication between the supply/drain passage 37 and the drain port 54 or connects the supply/drain passage 37 with the drain port 54 through the annular groove 52*d*.

The shaft portion 52*c* is surrounded by the annular space or groove 52*d* formed axially between the first and second lands 52*a* and 52*b*, and arranged to connect the passage 36 with the supply/drain passage 37, as shown in FIG. 5A, or to connect the supply/drain passage 37 and drain port 54, as shown in FIG. 5B.

Operation of First Embodiment

In the state shown in FIG. 1, by the resulting force of the spring forces of first coil spring 27 and second coil spring 28, the upper surface of arm 23 of cam ring 5 abuts against stopper surface 26*a* in a lower end of one retaining portion 26. In this state, the eccentricity is greatest, and the volume change of each pumping chamber 21 with rotation is greatest. Therefore, the discharge volume or capacity of the oil pump is greatest.

The rotor 4 of the pump main body is rotated in the clockwise direction as shown by an arrow in FIG. 1, by the drive shaft 3, and hence the pump chambers 21 expand in the state opening to the intake port 11 in a left side region on the left side in FIG. 1. Intake port 11 is allowed to suck the oil from the oil pan outside the pump through the intake hole or opening 11*a*. In a right side region in FIG. 1, the pump chambers 21 shrink in the state opening to the drain port 12, so that the oil is discharged to discharge port 12. Drain port 12 is connected through discharge hole 12*a* and discharge passage 12*b* with main oil gallery 13. Therefore, the oil discharged from the pump is supplied basically to various portions of the engine such as sliding contact portions.

The pump discharge pressure is introduced from branch passage 29, through first communication passage 35 and first communication hole 14, to first control chamber 16. The oil pressure introduced into first control chamber 16 acts on the upper outside circumferential surface (pressure receiving surface) of cam ring 5, and thereby acts as a force to move cam ring 5 rotationally in the counterclockwise direction about pivot pin 10 against the spring force of first coil spring 27. In this case, the spring force of second coil spring 28 acts as an assist force to rotate cam ring 5.

When the pump discharge pressure increases with increase in the engine speed, and the cam ring 5 is rotated slightly in the counterclockwise direction until the state shown in FIG. 6 is reached, then the upper surface of arm 23 moves slightly away from the stopper surface 26*a* of one retaining portion 26. In this state, the lower end of second coil spring 28 does not abut on the retaining portions 26 yet, so that the spring force of second coil spring 28 acts as the assist force.

When the state shown in FIG. 7 is reached by further rotation of cam ring 5 in the counterclockwise direction, the second coil spring 28 abuts against the upper surfaces of retaining portions 26, 26. Therefore, second coil spring 28 stops providing the assist force. In order to further rotate the cam ring 5 to the state shown in FIG. 8, the oil pressure in first control chamber 16 must be increased beyond the spring load of first coil spring 27.

When the state of FIG. 8 is reached by further increase of the oil pressure in first control chamber 16 and further rotation of cam ring 5 in the counterclockwise direction against the force of first coil spring 27, the eccentricity of the cam ring 5 with respect to the rotation axis of drive shaft 3 is further decreased, and the pump discharge pressure is decreased.

FIG. 10 shows a relationship between the engine rotational speed and the pump discharge pressure of the pump main body. A solid line in FIG. 10 represents a pump discharge pressure characteristic according to the first embodiment.

In the state just after an engine start, the pump main body is in the state shown in FIG. 1 and the oil pressure in main oil gallery 13 is applied only into first control chamber 16, through branch passage 29 and first communication passage 35 and first communication hole 14. At this time point, the eccentricity is greatest and the volume is greatest. Therefore, the discharge pressure increases steeply in proportion to an increase of the rotational speed.

When this discharge pressure becomes equal to a predetermined pressure Pa (a first operating pressure) which is a pressure exceeding a required pressure (1) shown in FIG. 10 required by the valve timing control apparatus, as shown in FIG. 6, the cam ring 5 starts rotating in the direction (counterclockwise direction) decreasing the eccentricity, by the force produced by the oil pressure in first control chamber 16 and the spring force of second coil spring 28, surmounting the spring force of first coil spring 27.

With rotation of cam ring 5 in the direction decreasing the eccentricity, the pump volume of the pump main body becomes smaller, and hence the increase of the discharge pressure becomes gradual with the increase of the rotation speed. When cam ring 5 is rotated to the state shown in FIG. 7, the second coil spring 28 abuts against the retaining portions 26, 26, and therefore, the assistance of second coil spring 28 is decreased abruptly to null.

Accordingly, cam ring 5 is unable to rotate, and the eccentricity is fixed. Therefore, the pump volume is fixed at a constant value, and the oil pressure is increased in proportion to the rotational speed increase.

The slope of the oil pressure increase is smaller as compared to the slope just after the engine start because the eccentricity of cam ring 5 is smaller as compared to the state of FIG. 1.

When the oil pressure reaches a predetermined pressure Pb (a second operating pressure) exceeding a required oil pressure (3) of the crankshaft bearing, the force of the oil pressure in first control chamber 16 enables the cam ring 5 to rotate again against the spring force of first coil spring 27, and the state of FIG. 8 is reached. In the case in which there is a required oil pressure (2') for the oil jet on the way, the eccentricity in the state shown in FIG. 7 is so set to satisfy this requirement.

Relationship Between the Oil Temperature of the Engine and the Pump Discharge Pressure The oil temperature of the engine and the pump discharge pressure are related with each other in the following manner.

When, for example, the engine oil temperature is lower than or equal to a predetermined temperature (a normally used temperature such as 100° C., for example) in an engine starting operation or the like, the oil passage 36 is shut off by thermosensitive valve 6. Therefore, the pump discharge pressure flowing into the branch passage 29 is introduced only to the first control chamber 16 through first communication passage 35, from first communication hole 14.

More specifically, as shown in FIG. 4A, the drive portion 40 of thermosensitive valve 6 is not operated, and the valve member 32 is held at the lower position by the spring force of valve spring 38. In this state, the oil flowing into the upper portion of cylinder bore 31 from branch passage 29 flows through passage holes 32*c* into the lower portion of cylinder bore 31, and further flows through first communication passage 35 into first control chamber 16. In this state, the oil passage 36 is connected through the annular space 32*e* of valve member 32 to the drain port 43 leading to the oil pan. Therefore, the oil is not introduced to pilot valve 7 and to second control chamber 17.

When the engine oil temperature becomes equal to or higher than about 100° C., for example, the drive portion 40 of thermosensitive valve 6 moves upwards against the spring force of valve spring 38 with the expansion of wax pellets 41, as shown in FIG. 4B, and the valve member 32 moves upwards together. Therefore, the valve portion 32*f* of valve member 32 shuts off the communication between the passage 36 and drain port 43, and connects the oil passage 36 with branch passage 29 through passage holes 32*c*. The oil passage 36 is connected with the supply/drain passage 37 through pilot valve 7, and the discharge pressure is introduced into second control chamber 17.

When the discharge pressure is introduced into second control chamber 17, the oil pressure acts in the direction (clockwise direction) increasing the eccentricity of cam ring 5, the pressure Pc (first operating pressure) increases to Pd as shown by a dotted line in FIG. 10. Accordingly, when the oil temperature increases, the discharge pressure is increased by a low pump rotation and injected from the oil jet around the piston, to secure the durability of the piston. When the rotation speed is further increased, the discharge pressure becomes excessive, and therefore, the pilot valve 7 adjusts the oil pressure supplied to second control chamber 17.

Specifically, When the discharge pressure exceeds the required pressure (2) of the oil jet, and reaches an operation pressure Pe of pilot valve 7 which is set at a value lower than a metal required pressure (3) of the crank shaft bearing, the spool 52 moves downwards to a predetermined position as shown in FIG. 5B, against the spring force of valve spring 53, by the discharge pressure acting on the pressure receiving surface 52*e* of first land 52*a* of spool 52.

Therefore, the first land 52*a* closes the open end 36*b* of oil passage 36 and the annular groove 52*d* connects the supply/drain passage 37 with drain port 54 to discharge the oil in second control chamber 17 from drain port 54 to the oil pan. Consequently, the pressure in second control chamber 17 becomes lower, the cam ring 5 rotates in the direction to decrease the eccentricity, and hence the discharge pressure in the passage 35 becomes lower.

Accordingly, the spool 52 moves upwards again by the spring force of valve spring 53 to the uppermost position as shown in FIG. 5A, and connects the passage 36 with the supply/drain passage 37, so that the discharge pressure is supplied to second control chamber 17. Consequently, by the operation of pilot valve 7, the discharge pressure is controlled at a constant level approximately equal to Pe, as shown by a dotted line in FIG. 10.

In a high engine speed region, because of continuation of the state in which the oil is drained from second control chamber 17, the discharge pressure is not introduced into second control chamber 17 even in the state in which the branch passage 29 is connected to the passage 36 by thermosensitive valve 6. Therefore, the discharge pressure overlaps a solid line in FIG. 10.

Thus, at the time of a normally-used oil temperature (100° C. or lower) of the engine, the variable displacement pump according to the first embodiment can decrease the pump discharge oil quantity and the oil pressure in the low and medium speed region, with the thermosensitive valve 6, and therefore can reduce the consumed energy of the pump.

When the engine oil temperature increases into a high oil temperature region (higher than or equal to 100° C.), it is possible to cool the piston by injecting the oil from the oil jet around the piston from the low and medium speed region, so that the reliability is improved.

In the illustrate example of the first embodiment, the axial width of annular groove 52*d* of spool 52 in pilot valve 7 is substantially equal to an axial distance between the open end 36*b* of passage 36 and the open end 54*a* of drain port 54, so that the changeover of oil passages is performed simultaneously. However, it is possible to make either slightly wider than the other according to a required discharge pressure characteristic.

Second Embodiment

Figure 11:
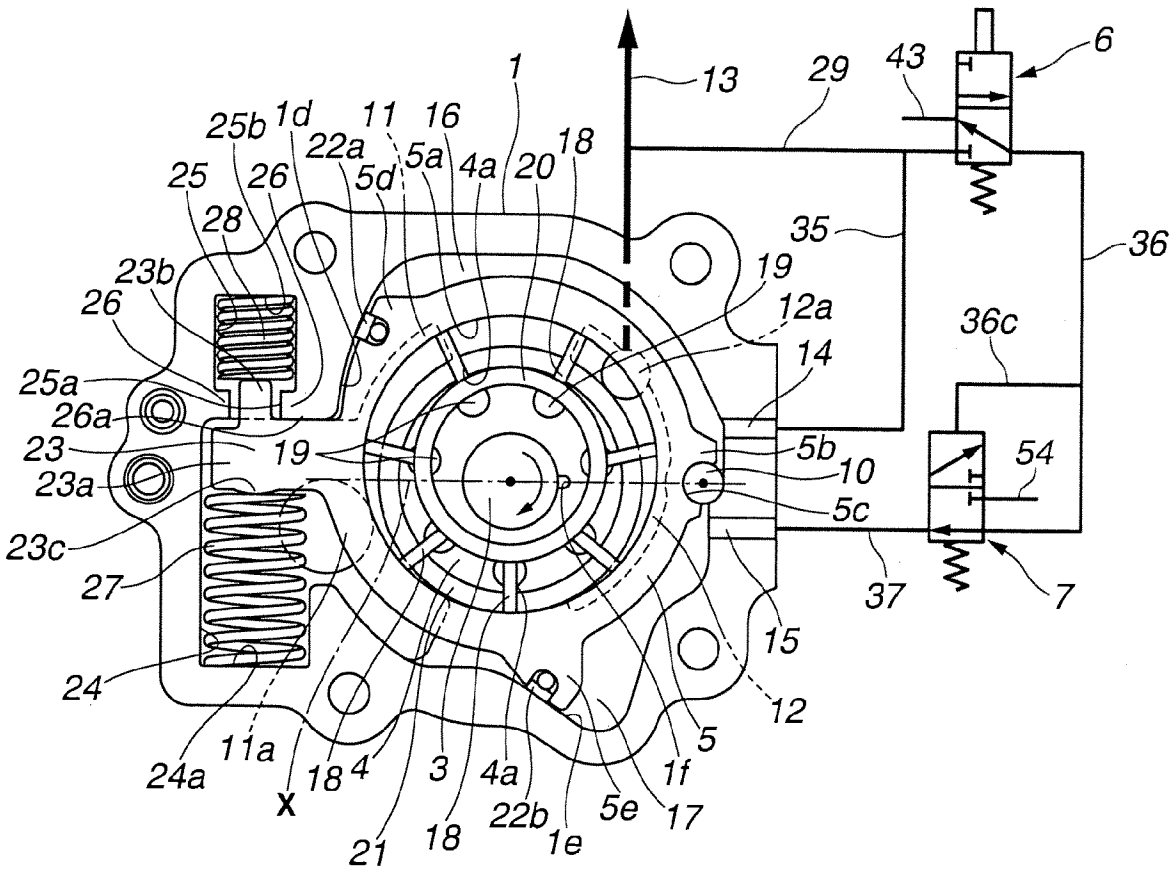
FIG. 11 is a schematic view showing a variable displacement pump according to a second embodiment.

FIG. 11 shows a variable displacement pump according to a second embodiment. The pilot valve 7 is connected with a downstream end of a branch passage 36*c* branching off from the connection passage 36. The downstream end of branch passage 36*c* is connected to the upper portion bounded by the pressure receiving surface 52*e* of first land 52*a* of spool 52. Thus, the spool 52 receives the discharge pressure on the downstream side of thermosensitive valve 6. With this arrangement, the variable displacement pump according to the second embodiment can provide operations and effects similar to those of the first embodiment.

Third Embodiment

Figure 12:
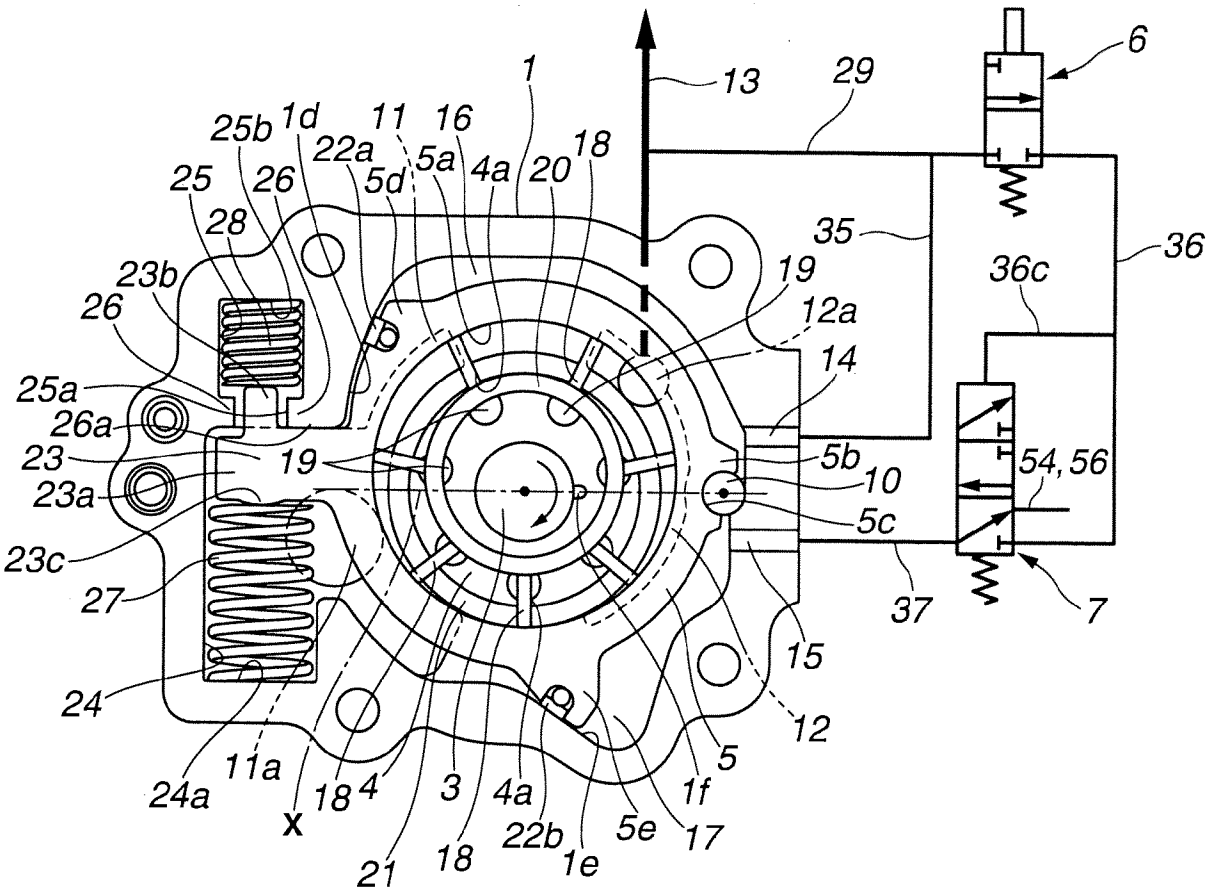
FIG. 12 is a schematic view showing a variable displacement pump according to a third embodiment.

FIGS. 12~14 show a variable displacement pump according to a third embodiment. In the third embodiment, unlike the first embodiment, the pilot valve 7 is configured to have a drain function of second control chamber 17 in the initial state, instead of thermosensitive valve 6.

Figure 13B:
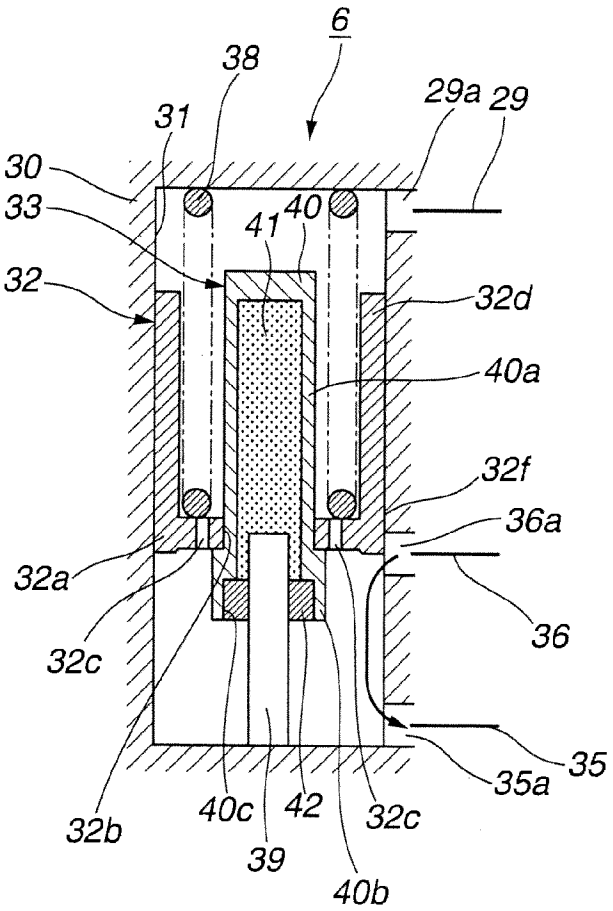
FIGS. 13A and 13B are views for illustrating operation of a thermosensitive valve in the third embodiment.
Figure 13A:
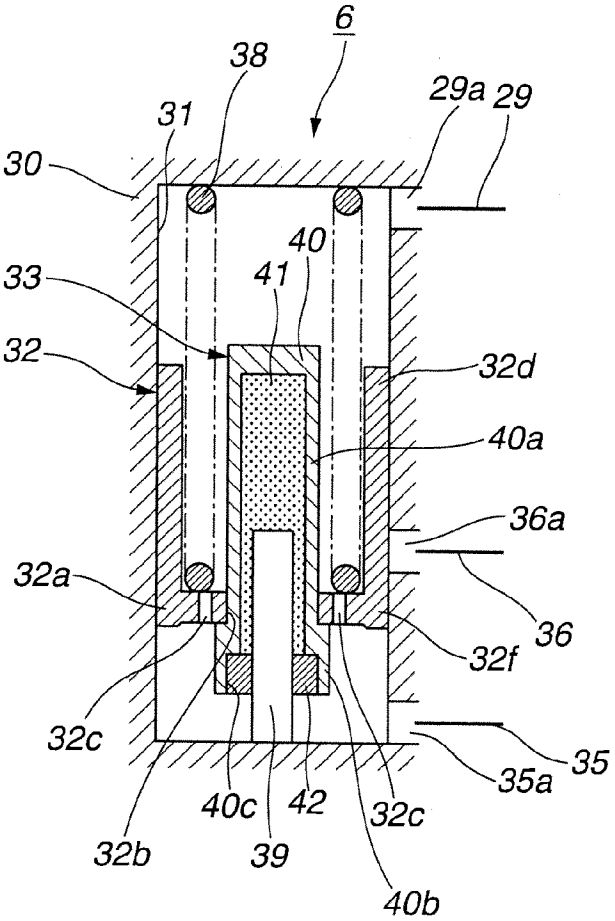

Specifically, in thermosensitive valve 6, as shown in FIGS. 13A and 13B, the drain port (43) is eliminated, and the cylinder bore 31 is formed with three openings: the open end 29*a* of branch passage 29, the open end 36*a* of connection passage 36, and the open end 35*a* of first communication passage 35. Moreover, the annular groove (32*e*) is not formed in the outside circumferential surface of valve member 32.

Figure 14C:
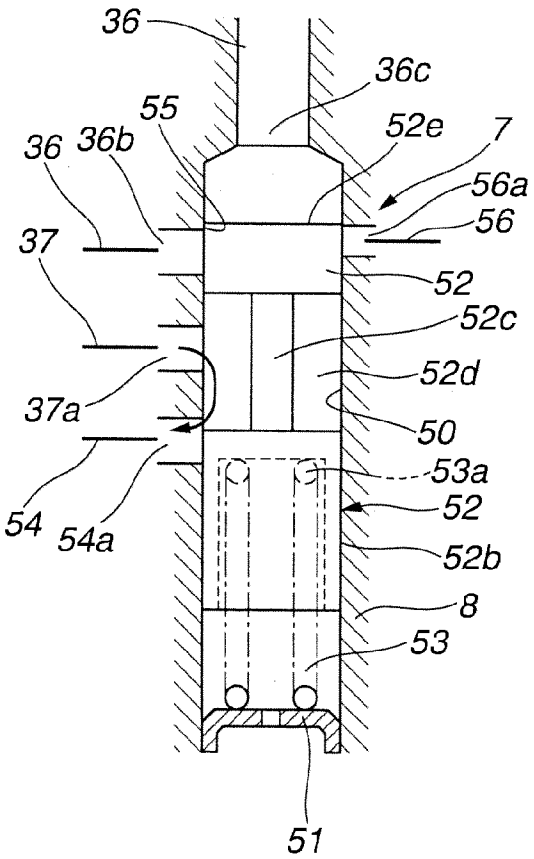
FIGS. 14A, 14B and 14C are views for illustrating operation of a pilot valve in the third embodiment.
Figure 14B:
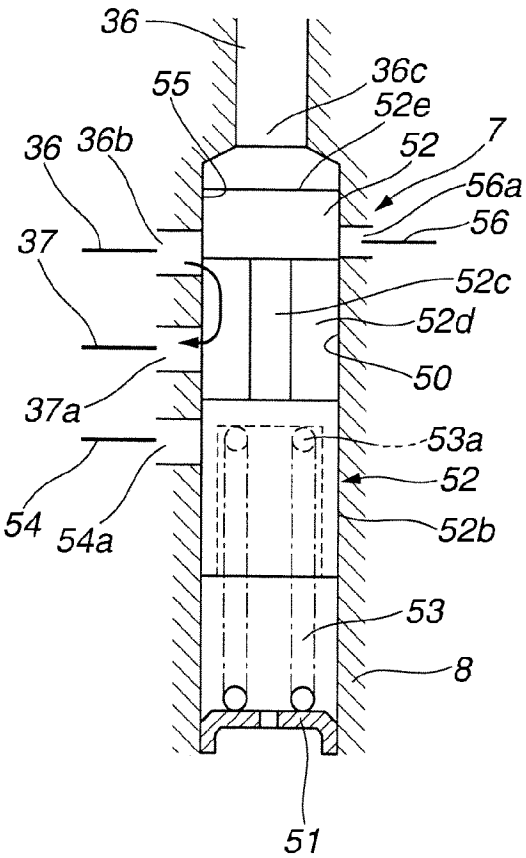
Figure 14A:
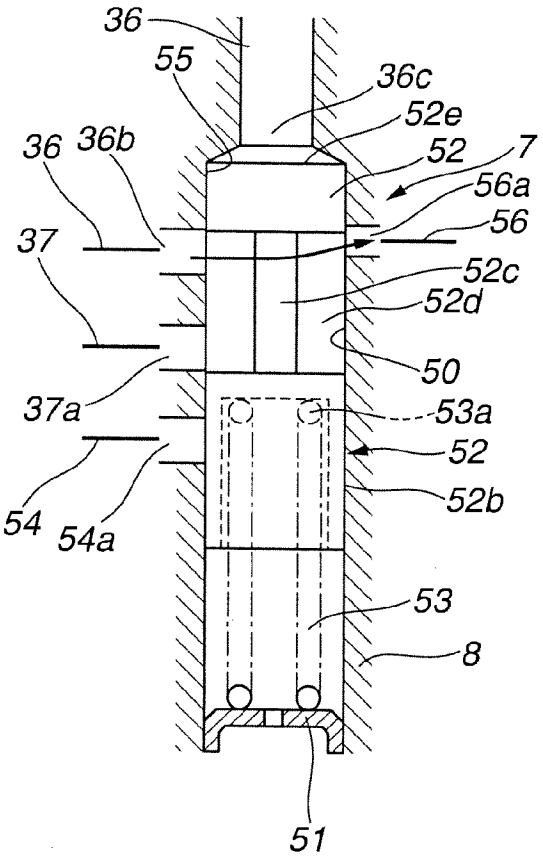

In the pilot valve 7, as shown in FIGS. 14A-14C, the open end of branch passage 36*c* of connection passage 36 is opened into the upper portion bounded by the pressure receiving surface 52*e* of first land 52*a* of spool 52; and an open end 56*a* of a second drain port 56 is opened to a slide bore 50 at a position diametrically opposite to the position of the open end 36*b* of first communication passage 36.

Therefore, at engine oil temperatures lower than or equal to the predetermined temperature, the drive portion 40 in thermosensitive valve 6 is not operated and the valve member 32 is held at the lower position, as shown in FIG. 13A. Therefore, the connection between branch passage 29 and first communication passage 35 is held, and the discharge pressure is supplied to first control chamber 16. However, the open end 36*a* of connection passage 36 is closed by the circumferential wall 32*d* of valve member 32, and the discharge pressure is not supplied toward pilot valve 7.

On the other hand, in pilot valve 7, as shown in FIG. 14A, since the discharge pressure from connection passage 36 is not applied to the pressure receiving surface 52*e* of spool 52, the spool 52 is held at the uppermost position by the spring force of valve spring 53, and the second communication passage 37 is connected with second drain port 56. Therefore, the second control chamber 17 is in a lower pressure state.

When the engine oil temperature increases gradually and reaches the predetermined temperature, the drive portion 40 in thermosensitive valve 6 is moved gradually upwards together with valve member 32 with the expansion of wax pellets 41, against the spring force of valve spring 38, and held at the position shown in FIG. 13B. Therefore, the opening area of open end 36*a* of connection passage 36 is increased gradually, and the connection passage 36 is connected with branch passage 29 through passage holes 32*c*.

Therefore, the discharge pressure is supplied to the pressure receiving surface 52*e* of first land 52 of pilot valve 7, the spool 52 moves downwards by a predetermined amount, as shown in FIG. 14B, against the spring force of valve spring 53 with an increase of the discharge pressure, and the first land 52*a* closes the open end 56*a* of second drain port 56. Therefore, the oil from connection passage 36 flows into second communication passage 37 through the annular groove 52*d*, and then flows into second control chamber 17.

When spool 52 is further moved downwards by increase of the discharge pressure, as shown in FIG. 14C, the first land 52*a* closes the open end 36*b* of connection passage 36 in the state closing second drain port 56. At the same time, second land 52*b* opens the open end 54*a* of drain port 54. Accordingly, the second communication passage 37 is connected with drain port 54, and the pressure in second control chamber 17 is decreased.

Therefore, the third embodiment can provide similar operations and effects as in first embodiment. Moreover, in the third embodiment, drain port 43 of thermosensitive valve 6 and annular groove 32*e* of valve member 32 are eliminated, so that the structure is simplified and the manufacturing process is made easier.

Fourth Embodiment

Figure 15:
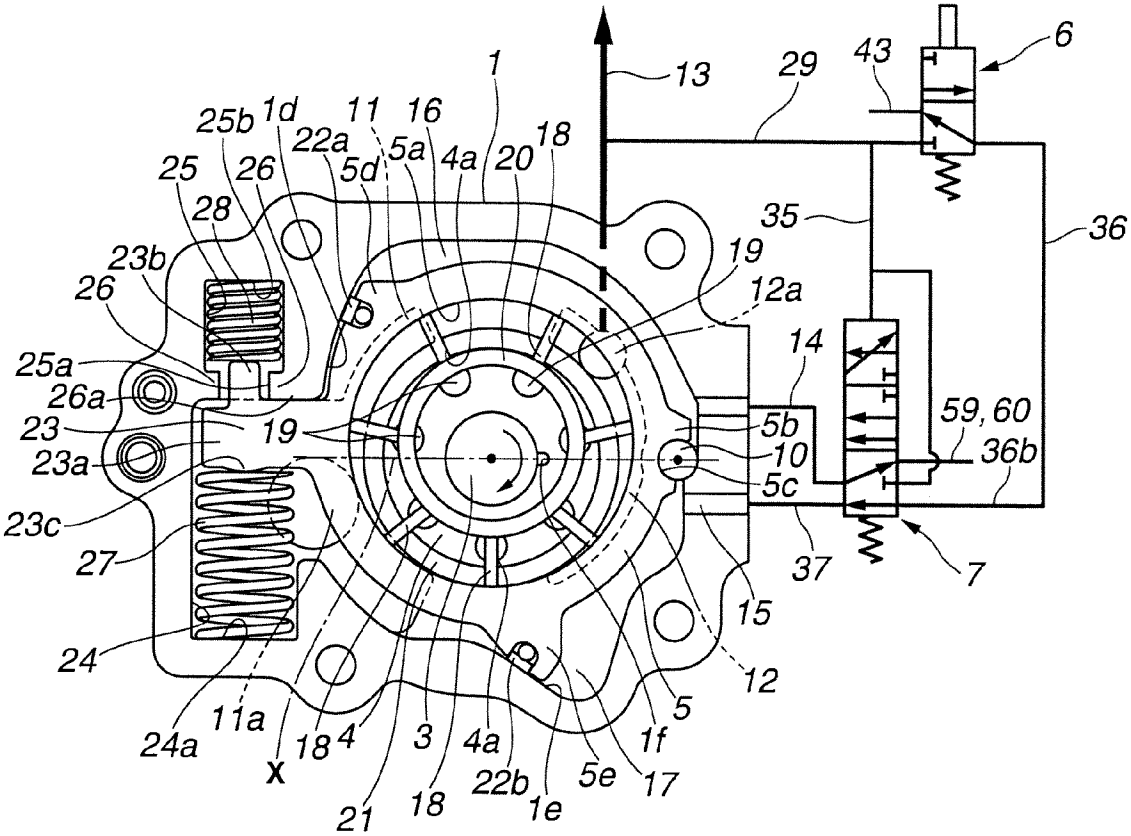
FIG. 15 is a schematic view showing a variable displacement pump according to a fourth embodiment.

FIGS. 15 and 16 show a variable displacement pump according to a fourth embodiment in which the internal pressure in first control chamber 16 is controlled by a second pilot valve 57.

Figure 16C:
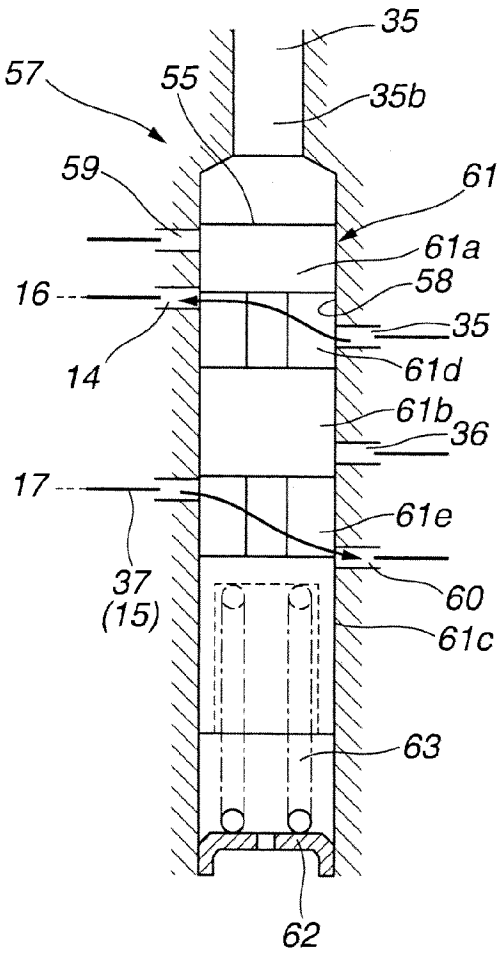
FIGS. 16A, 16B and 16C are views for illustrating operation of a second pilot valve in the fourth embodiment.
Figure 16B:
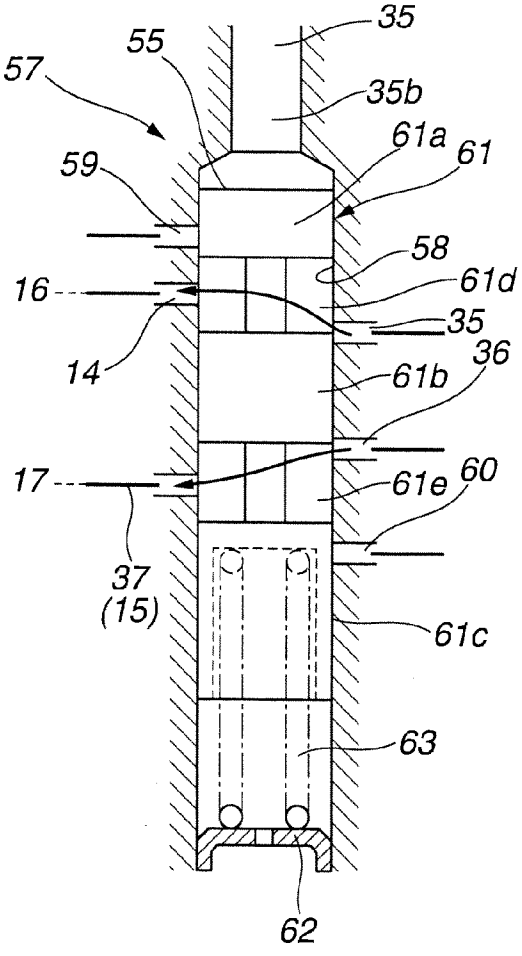
Figure 16A:
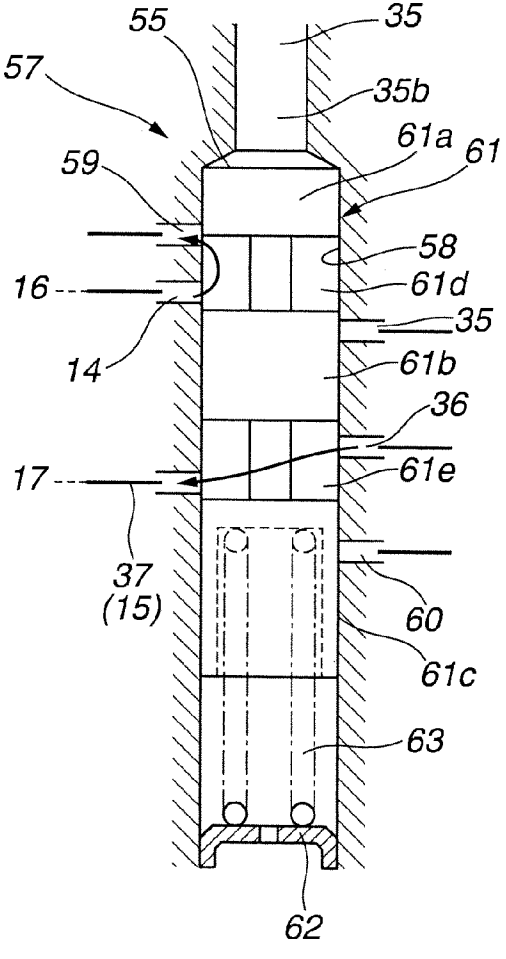

As shown in FIGS. 16A-16C, the second pilot valve 57 includes slide bore 58 extending in the up and down direction. In the slide bore 58, the first communication passage 35 is connected axially to an upper portion. A first drain port 59 is connected to the upper portion on the left side as viewed in the figures. On the lower side of the open end of drain port 59, the first communication hole 14 leading to first control chamber 16 is connected. On the lower side of the first communication hole 14, the second communication passage 37 leading to second control chamber 17 is connected.

On the right side in the figures, the slide bore 58 is connected with the first communication passage 35 at an upper position, the connection passage 36 at a middle position below the upper position, and a second drain port 60 at a lower position below the middle position.

A spool 61 extending in an axial direction is slidably received in the slide bore 58. A lower open end of slide bore 58 is closed by an end member 62.

Spool 61 includes a first land 61*a* at an upper end, a second land 61*b* at a middle or intermediate position, and a third land 61*c* at a lower end. A first annular groove 61*d* is formed axially between the first and second lands 61*a* and 61*b* around a small diameter shaft portion. A second annular groove 61*e* is formed axially between the second and third lands 61*b* and 61*c* around a small diameter shaft portion. The spool 61 is urged upwards by a valve spring 63.

The first coil spring 27 is set at a spring load to start rotation of cam ring 5 at a pressure Pa' lower than the first operation pressure Pa shown in FIG. 10. The second pilot valve 57 is arranged to connect the first control chamber 16 (first communication hole 14) with first drain port 59 when the discharge pressure is lower than or equal to the first operation pressure Pa, and to connect first control chamber 16 with first communication passage 35 above the first operation pressure Pa, that is when the discharge pressure is higher than Pa.

Thermosensitive valve 6 has the same construction as in the first embodiment.

Pilot valve 57 is held in the state shown in FIG. 16A when the discharge pressure is low or the oil temperature is low, and hence the pressure in first communication passage 35 is low. In this state shown in FIG. 16A, the spool 61 is held and seated at the uppermost position in slide bore 58 by valve spring 63. In this state of FIG. 16A, the first annular groove 61*d* connects the first drain port 59 with first communication hole 14, and the second land 61*b* closes the first communication passage 35.

On the other hand, the connection passage 36 is connected with second communication passage 37 by the second annular groove 61*e*, and the second drain port 60 is closed by third land 61*c*. This state is the same as the state of pilot valve 7 according to the first embodiment for adjusting the internal pressure of second control chamber 17.

When the discharge pressure reaches Pa, the oil pressure acting on the pressure receiving surface 61*f* of first land 61*a* from the first communication passage 35 causes the spool 61 to move downwards against the spring force of valve spring 63, to the position shown in FIG. 16B. In this state, the first land 61*a* holds the first communication hole 14 open, closes the first drain port 59, and opens the end 35*b* of first communication passage 35. Therefore, the first communication hole 14 is connected with the first communication passage 35, and the discharge pressure is introduced into first control chamber 16. In this case, the applied pressure is higher than or equal to the operation pressure Pa' due to the spring force of first coil spring 27. Therefore, cam ring 5 starts rotating in the counterclockwise direction. Then the oil pressure is regulated so that the discharge pressure becomes equal to Pa, like the above-mentioned operation of pilot valve 7.

Therefore, the discharge pressure Pa at this time point shows a substantially constant pressure characteristic as shown by a one dot chain line in FIG. 10.

When the engine oil temperature is high, the discharge pressure acts in second control chamber 17 as in the first embodiment. When the discharge pressure reaches Pe, the second land 61*b* closes the connection passage 36 as show in FIG. 16C, and the third land 61*c* opens the second drain port 60, and connects second drain port 50 with second communication passage 37, so that the oil pressure in second control chamber 17 is drained and adjusted as in the first embodiment.

Therefore, the fourth embodiment can provide similar operations and effects as in the first embodiment. In the first embodiment, the discharge pressure is increased gradually after a start of operation of cam ring 5 at the discharge pressure Pa, because of influence of the spring constants of first and second coil springs 27 and 28. However, in the fourth embodiment, as mentioned above, the discharge pressure is regulated constantly at Pa by pilot valve 7, so that an oil pressure increase is prevented and the consumption of power is reduced.

Fifth Embodiment

Figure 17:
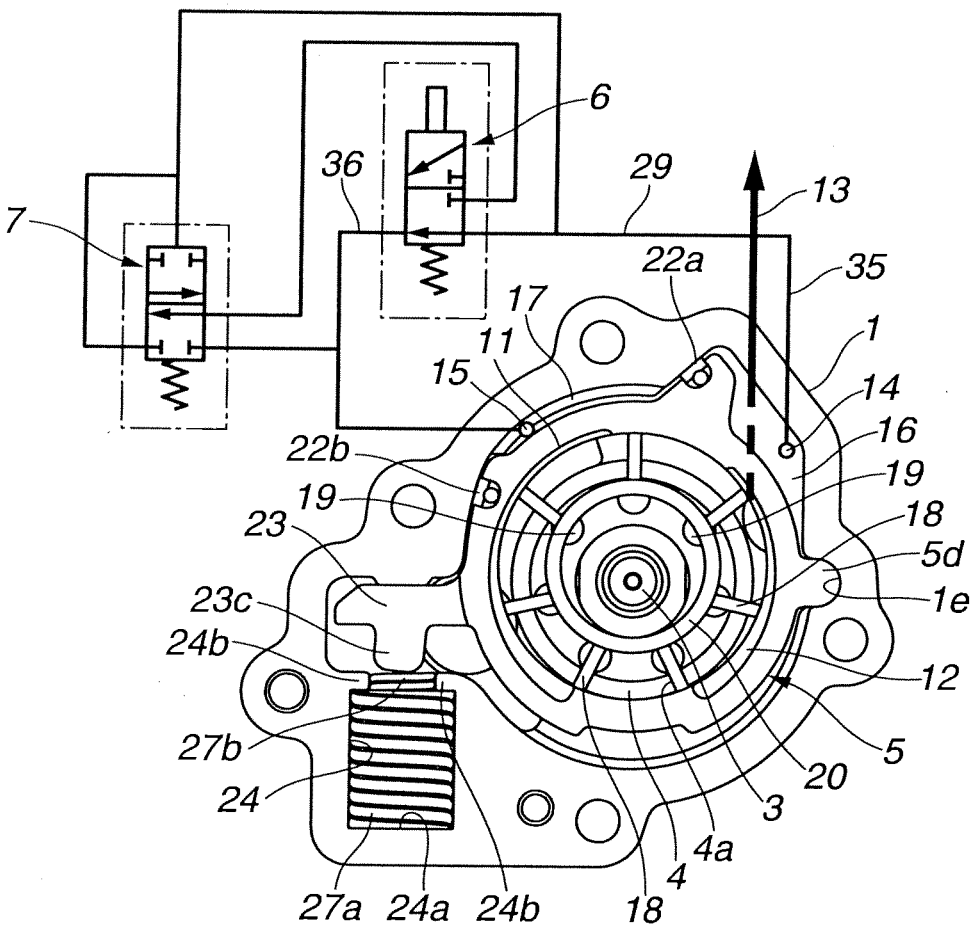
FIG. 17 is a schematic view showing a variable displacement pump according to a fifth embodiment.
Figure 18:
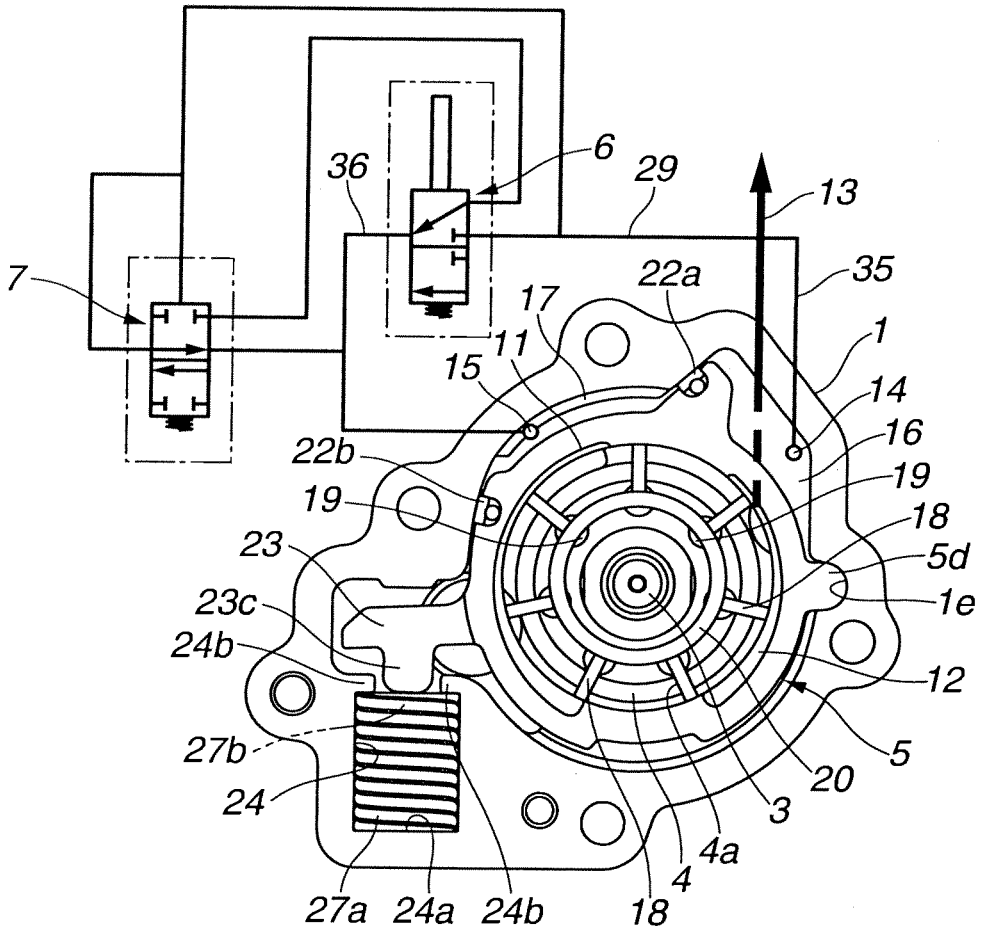
FIG. 18 is a schematic view for illustrating operation of the variable displacement pump according to the fifth embodiment.

FIGS. 17 and 18 shows a variable displacement pump according to a fifth embodiment. The first control chamber 16 and second control chamber 17 are formed side by side on the upper side so that the pivot pin 10 is not located between first and second control chambers 16 and 17.

Furthermore, the first coil spring for applying the spring force in the direction increasing the eccentricity of cam ring 5 is constituted by outer and inner springs 27*a* and 27*b*. The outer coil spring 27*a* having a larger coil diameter is disposed between stopper lower surfaces of retaining portions 24*b* and 24*b* projecting inwards toward each other at the upper end of first spring chamber 24, and a bottom surface 24*a* of spring chamber 24, and provided preliminarily with a spring set load. The inner coil spring 27*b* having a smaller coil diameter is disposed between the raised portion or projection 23*c* projecting from the lower surface of the arm 23 and the bottom surface 24*a* of spring chamber 24, and provided preliminarily with a set load.

Since the first and second control chambers 16 and 17 are formed on the same side, the oil pressure applied in either or both of first and second control chambers 16 and 17 acts to decrease the eccentricity of cam ring 5 and decrease the pumping volume.

The operation pressure to start rotation of cam ring 5 in the counterclockwise direction against the spring forces of two coil springs 27*a* and 27*b* becomes lower when the oil pressure is applied to both chambers and hence an oil pressure force is increased. The operation pressure becomes higher when the oil pressure is applied to only one of the control chambers.

In this example of the fifth embodiment, the first operation pressure is set equal to Pa in FIG. 10 when the oil pressure is introduced to both control chambers 16 and 17. The first operation pressure is set at Pc when the oil pressure is introduced only to the first control chamber 16.

The pivot pin 10 is eliminated. Instead, the cam ring 5 is formed integrally with a pivot projection 5*d* which projects outwards from the outer circumference and which is fit in a pivot groove 1*e* formed in pump housing 1. Cam ring 5 is rotatable in the counterclockwise direction and clockwise direction about a fulcrum defined by the pivot projection 5*d* and the pivot groove 1*e*.

The hydraulic circuit and the structures of thermosensitive valve 6 and pilot valve 7 are the same as those of the first embodiment.

The variable displacement pump according to the fifth embodiment is operated in the following manner. FIG. 17 shows an initial state at the time of a start of the engine (the pump).

When the oil pressure is applied to first and second control chambers 16 and 17, and cam ring 5 is rotated in the counterclockwise direction, first only the inner coil spring 27*b* is compressed at an early stage of the movement. However, when the lower projection 23*c* of arm 23 moves downwards through the gap between the retaining portions 24*b* and 24*b*, the lower projection 23*c* abuts against the upper end of outer coil spring 27*a* restricted by retaining portions 24*b*, 24*b*. Since the outer coil spring 27*a* is provided with the above-mentioned spring set load, the displacement of cam ring 5 and the spring load are related to each other as shown in FIG. 9 like the first embodiment. The oil pressure characteristic is in the form shown by a solid line in FIG. 10, like the first embodiment.

When the oil temperature becomes equal to a predetermined temperature, the thermosensitive valve 6 shuts off the communication between branch passage 29 and second control chamber 17, as shown in FIG. 18, and drains the oil in second control chamber 17 through pilot valve 7. In this case, the oil pressure characteristic is in a form as shown by a dotted line Pa~Pe in FIG. 10. When the discharge pressure reaches Pe, the pilot valve 7 is operated, and the second control chamber 17 is switched from the connection with the drain port to the connection with branch passage 29. Therefore, the discharge pressure is adjusted to Pe as in the first through third embodiments.

Variation Examples

Figure 19:
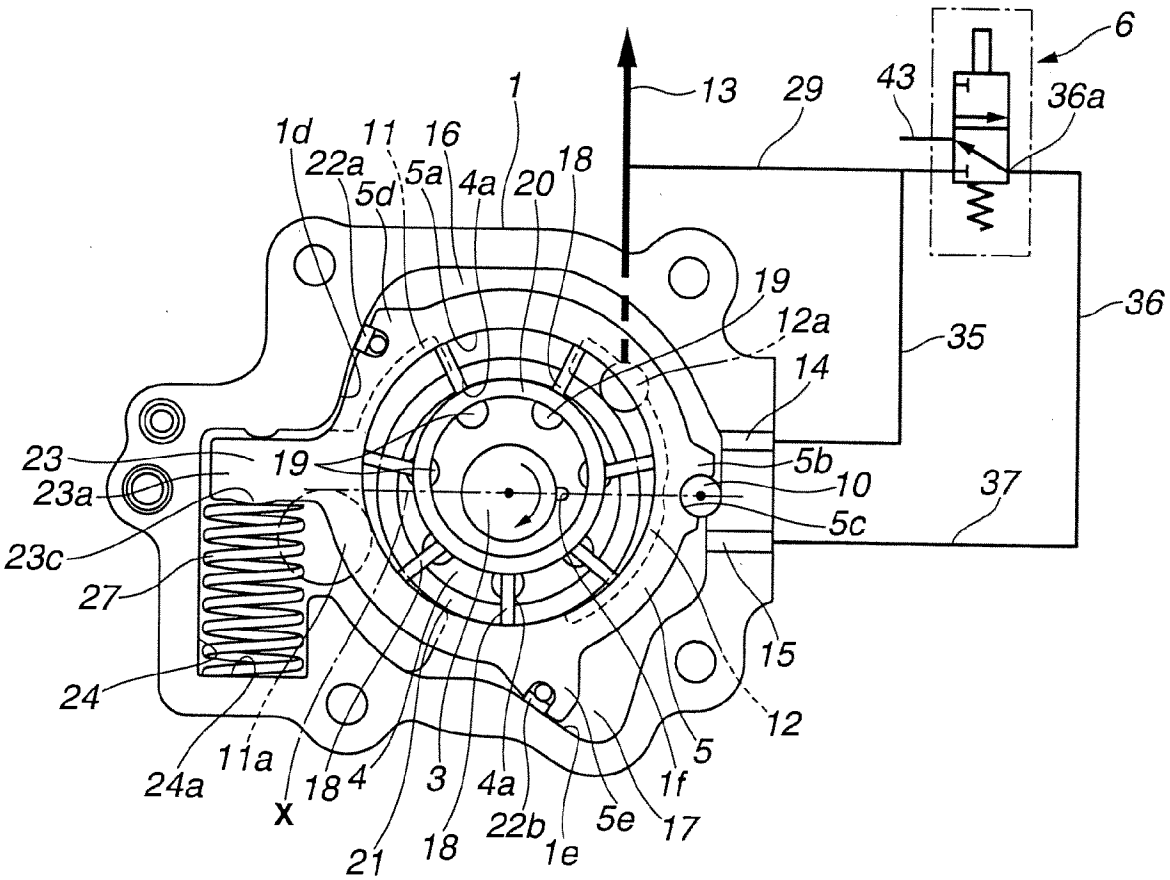
FIG. 19 is a schematic view showing a variable displacement pump in a variation example according to the present invention.

FIG. 19 shows a variable displacement pump in a variation example. In the pump main body, the second coil spring is eliminated and only the first coil spring is employed. The first and second control chambers 16 and 17 are formed, respectively, on the upper and lower sides of pivot pin 10 as in the first embodiment.

The pilot valve is eliminated, and the hydraulic circuit employs only the thermosensitive valve 6. Thermosensitive valve 6 is arranged to changeover the oil passages to change over the oil supply and the oil drainage of the second control chamber 17.

Therefore, thermosensitive valve 7 changes over the oil passages to select the discharge pressure or the lower pressure obtained by the drainage, as the pressure of second control chamber 17, in dependence on the oil temperature, and thereby makes it possible to obtain two different oil pressure characteristics of the operating oil pressure.

In this variation example, it is not possible to perform the minute control of the pressure in second control chamber 17 with the pilot valve. However, the construction of the variable displacement pump is simplified, so that the manufacturing process is easier and it is possible to improve the production efficiency and to reduce the production cost.

The present invention is not limited to the constructions of the pump main body, thermosensitive valve 6, and pilot valve 7 in the illustrated examples. Various variations and modifications are possible within the purview of the present invention.

Instead of the wax palettes in the thermosensitive valve 6, it is possible to use a member capable of converting a temperature change into a displacement or deformation, such as shape memory alloy and bi-metal.

According to one (first) aspect of the present invention, a variable displacement pump has a basic construction comprising: a rotor; a plurality of vanes slidably received in an outer circumference of the rotor; a cam ring which includes an inside circumferential surface enclosing the rotor and the vanes, having a center line eccentric from a rotation axis of the rotor, and defining a plurality of operating oil chambers or pumping chambers, and which is arranged to move to vary an eccentricity and thereby to vary a pumping volume; an intake portion or port opening into the operating oil chambers in a volume increasing region in which volumes of the operating oil chambers are increased with rotation of the rotor; a discharge portion or port opening into the operating oil chambers in a volume decreasing region in which the volumes of the operating oil chambers are decreased with rotation of the rotor; an urging mechanisms arranged to apply an urging force to the cam ring in an eccentric direction; a first control chamber arranged to receive an oil discharged from the discharge portion and to apply a force to the cam ring in a direction decreasing the eccentricity; a second control chamber arranged to receive the oil discharged from the discharge portion and to apply a force to the cam ring in a direction increasing the eccentricity; a thermosensitive mechanism to connect the second control chamber with the discharge portion or with a low pressure portion in accordance with an oil temperature; and a control valve to be operated by a discharge pressure of the discharge portion and to decrease a pressure in the second control chamber when the discharge pressure of the discharge portion becomes higher than or equal to a predetermined pressure.

According to the illustrated embodiments and variations of the present invention, it is possible to derive following technical concepts or ideas, in addition to the above-mentioned basic construction.

According to a technical concept "a", the thermosensitive mechanism includes a thermosensitive member arranged to operate in dependence on an oil temperature and a valve member to change over (a destination of) connection of the second control chamber between the discharge portion and the lower pressure portion in dependence on an operating position of the thermosensitive member.

According to a technical concept "b", the thermosensitive member is arranged to connect the second control chamber with the discharge portion through the valve member when the oil temperature is higher than or equal to a predetermined temperature, and to connect the second control chamber with the low pressure portion when the oil temperature is lower than the predetermined temperature.

According to a technical concept "c", the control valve is configured to decrease a communication area (or a flow passage area or size) of communication from the discharge portion to the second control chamber and to increase a communication area (or a flow passage area or size) of communication from the second control chamber to the lower pressure portion, by application of a discharge pressure of the discharge portion.

According to a technical concept "d", the control valve is configured to shut off communication between the discharge portion and the second control chamber when the control valve is operated to a predetermined position.

According to a technical concept "e", the control valve is configured to start operation at a pressure which is lower than a discharge pressure of the discharge portion at which the cam ring starts moving against the urging force of the urging mechanism when the discharge pressure of the discharge portion is applied only to the first control chamber and the eccentricity between the rotation axis of the rotor and the center of the inside circumferential surface of the cam ring becomes equal to or lower than the predetermined value.

According to a technical concept "f", the control valve is configured to operate when the discharge pressure of the discharge portion is higher than or equal to a predetermined pressure in a state in which the discharge pressure of the discharge portion is introduced into both the first and second control chambers, and the eccentricity between the rotation axis of the rotor and the center line of the inside circumferential surface of the cam ring is greatest (or greater than a predetermined level).

According to a technical concept "g", there is provided, between the control valve and the second control chamber, a restriction or throttle, and the control valve is arranged to discharge a pressure in the restriction and the second control chamber to the low pressure portion, in accordance with the discharge pressure of the discharge portion.

According to a technical concept "h", a first spring member of the urging mechanism is arranged to urge the cam ring in the direction increasing the eccentricity between the rotation axis of the rotor and the center line of the inside circumference of the cam ring, and a second spring member is arranged to urge the cam ring in the direction decreasing the eccentricity.

According to a technical concept "i", the first and second control chambers are formed on an outside circumferential surface of the cam ring (radially between the cam ring and a pump housing 1).

According to a technical concept "j", communication between the second control chamber and the low pressure portion is shut off when the discharge pressure of the discharge portion is not applied to the control valve.

According to another (second) aspect of the present invention, a variable displacement pump has a basic construction comprising: a pump forming member (such as a rotor) arranged to vary volumes of a plurality of operating oil chambers or pumping chambers, to suck an oil from an intake portion or port and to discharge the oil from a discharge portion or port; a varying mechanism including a movable member (such as a cam ring) to vary a pumping volume; an urging mechanism (including an urging member such as first and second spring members) arranged to apply, to the movable member (such as the cam ring), an urging force to increase the volume variation of the operating oil chambers opening in the discharge portion or to move the movable member in an eccentric direction (increasing an eccentricity of the movable member (the cam ring)); a first control chamber arranged to receive an oil discharged from the discharge portion and to apply a force to the movable member in a direction decreasing the volume variation of the operating oil chambers opening in the discharge portion or decreasing the eccentricity; a second control chamber arranged to receive the oil discharged from the discharge portion and to apply a force to the movable member in a direction increasing the volume variation of the operating oil chambers opening in the discharge portion or increasing the eccentricity; and a thermosensitive mechanism to change over connection of the second control chamber between the discharge portion and a low pressure portion, in dependence on an oil temperature and to decrease the force applied to the cam ring in the direction decreasing the eccentricity when the oil temperature is higher than a predetermined temperature. The variable displacement pump may further comprise a control valve to be operated by a discharge pressure of the discharge portion and to increase the force applied to the cam ring in the direction decreasing the eccentricity by adjusting a pressure in the second control chamber when the discharge pressure of the discharge portion becomes higher than or equal to a predetermined pressure. The urging mechanism may be further arranged to provide a lower pressure characteristic and a high pressure characteristic mechanically.

According to the illustrated embodiments and variations of the present invention, it is possible to derive following technical concepts or ideas, in addition to the above-mentioned basic construction of the second aspect of the present invention.

According to a technical concept "k", the control valve includes a spool which is slidable in a slide bore and which includes a first end portion including a pressure receiving surface receiving the pressure of the discharge portion, and a second end portion urged by an urging member (such as a valve spring) and held in a low pressure state; the slide bore is formed with an opening of a first port connected with the second control chamber, an opening of a second port connected through the thermosensitive mechanism with the second control chamber; and the spool is configured to increase an opening area of the first port and decrease an opening area of the second port by moving against an urging force of the urging member (beyond a predetermined level, or when an amount of movement of the spool is equal to or greater than a predetermined amount).

According to a technical concept "l", the control valve is configured to close the opening of the second port when the opening of the first port is opened.

This application is based on a prior Japanese Patent Application No. 2013-148098 filed on Jul. 17, 2013. The entire contents of this Japanese Patent Application are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement pump for an internal combustion engine, to supply oil to a hydraulic variable valve actuation device, an oil jet and a crankshaft bearing, comprising:

a rotor adapted to be driven by the internal combustion engine;

a plurality of vanes slidably received in an outer circumference of the rotor;

a cam ring which includes an inside circumferential surface enclosing the rotor and the vanes, having a center line eccentric from a rotation axis of the rotor, and defining a plurality of operating oil chambers, and which is arranged to move to vary an eccentricity and thereby to vary a pumping volume;

an intake portion opening into the operating oil chambers in a volume increasing region in which volumes of the operating oil chambers are increased with rotation of the rotor;

a discharge portion opening into the operating oil chambers in a volume decreasing region in which the volumes of the operating oil chambers are decreased with rotation of the rotor;

an urging mechanism including first and second spring members provided with respective spring loads, and arranged to apply an urging force to the cam ring in an eccentric direction with a spring force produced by the first and second spring members, and to increase the urging force of the first and second spring members stepwise when the cam ring is rotated in a concentric direction from a maximum eccentric position and the eccentricity of the cam ring becomes smaller than or equal to a predetermined value;

a first control chamber arranged to receive oil discharged from the discharge portion and to apply a force to the cam ring in a direction decreasing the eccentricity;

a second control chamber arranged to receive the oil discharged from the discharge portion and to apply a force smaller than the force produced by the first control chamber, to the cam ring in a direction increasing the eccentricity;

a thermosensitive mechanism disposed in a passage connecting the discharge portion with the second control chamber, to connect the second control chamber with the discharge portion in a higher oil temperature state and to connect the second control chamber with a low pressure portion in a low oil temperature state; and a control valve to be operated by a discharge pressure of the discharge portion and to decrease a pressure in the second control chamber when the discharge pressure of the discharge portion becomes higher than or equal to a predetermined pressure.

2. The variable displacement pump as recited in claim 1, wherein the thermosensitive mechanism includes a thermosensitive member arranged to operate in dependence on an oil temperature and a valve member to change over connection of the second control chamber between the discharge portion and the lower pressure portion in dependence on an operating position of the thermosensitive member.

3. The variable displacement pump as recited in claim 2, wherein the thermosensitive member is arranged to connect the second control chamber with the discharge portion through the valve member when the oil temperature is higher than or equal to a predetermined temperature, and to connect the second control chamber with the low pressure portion when the oil temperature is lower than the predetermined temperature.

4. The variable displacement pump as recited in claim 1, wherein the control valve is configured to decrease a communication area from the discharge portion to the second control chamber and to increase a communication area from the second control chamber to the lower pressure portion, by application of a discharge pressure of the discharge portion.

5. The variable displacement pump as recited in claim 4, wherein the control valve is configured to shut off communication between the discharge portion and the second control chamber when the control valve is operated to a maximum operation position.

6. The variable displacement pump as recited in claim 1, wherein the control valve is configured to start operation at a pressure which is lower than a discharge pressure of the discharge portion at which the cam ring starts moving against the urging force of the urging mechanism increased stepwise when the discharge pressure of the discharge portion is applied only to the first control chamber and the eccentricity between the rotation axis of the rotor and the center of the inside circumferential surface of the cam ring becomes equal to or lower than the predetermined value.

7. The variable displacement pump as recited in claim 1, wherein the control valve is configured to operate when the discharge pressure of the discharge portion is higher than or equal to a predetermined pressure in a state in which the discharge pressure of the discharge portion is introduced into both the first and second control chambers, and the eccentricity between the rotation axis of the rotor and the center line of the inside circumferential surface of the cam ring is greatest.

8. The variable displacement pump as recited in claim 1, wherein there is provided, between the control valve and the second control chamber, a restriction, and the control valve is arranged to discharge a pressure in the restriction and the second control chamber to the low pressure portion, in accordance with the discharge pressure of the discharge portion.

9. The variable displacement pump as recited in claim 1, wherein the first spring member of the urging mechanism is arranged to urge the cam ring in the direction increasing the eccentricity between the rotation axis of the rotor and the center line of the inside circumference of the cam ring, and the second spring member is arranged to urge the cam ring in the direction decreasing the eccentricity.

10. The variable displacement pump as recited in claim 1, wherein the first and second control chambers are formed on an outside circumferential surface of the cam ring.

11. The variable displacement pump as recited in claim 10, wherein communication between the second control chamber and the low pressure portion is shut off when the discharge pressure of the discharge portion is not applied to the control valve.

12. The variable displacement pump as recited in claim 1, wherein the thermosensitive mechanism is configured to connect the second control chamber with the discharge portion to supply the discharge pressure of the variable displacement pump from the discharge portion to the second control chamber in the higher oil temperature state to increase the discharge pressure of the variable displacement pump to a pressure level required for the oil jet.

13. The variable displacement pump as recited in claim 1, wherein the thermosensitive mechanism includes a thermosensitive valve including a first port connected with the discharge portion which is a discharge port of the variable displacement pump and arranged to receive the discharge pressure of the variable displacement pump from the discharge port, a second port connected with the control valve, a third port connected with the low pressure portion and a valve member configured to take a first valve position to disconnect the second port from the first port and to connect the second port with the third port in the low temperature oil temperature state, and a second valve position to disconnect the second port from the third port and to connect the second port with the first port to supply the discharge pressure to the second control chamber through the control valve in the higher oil temperature state.

14. A variable displacement pump for an internal combustion engine, comprising:

a pump forming member arranged to vary volumes of a plurality of operating oil chambers by being driven by the internal combustion engine, to suck oil from an intake portion and to discharge the oil from a discharge portion;

a varying mechanism including a movable member to move to vary volume variation of the operating oil chambers opening to the discharge portion;

an urging mechanism including first and second spring members arranged to apply, to the movable member, an urging force increasing the volume variation of the operating oil chambers opening in the discharge portion with a spring force produced by the first and second spring members, and to increase the urging force of the first and second spring members stepwise when the volume variation is decreased to a value smaller than or equal to a predetermined value from a maximum volume variation state of the movable member;

a first control chamber arranged to receive oil discharged from the discharge portion and to apply a force to the movable member in a direction decreasing the volume variation of the operating oil chambers opening in the discharge portion;

a second control chamber arranged to receive the oil discharged from the discharge portion and to apply a force smaller than the force produced by the first control chamber, to the movable member in a direction increasing the volume variation of the operating oil chambers opening in the discharge portion;

a thermosensitive mechanism disposed in a passage connecting the discharge portion with the second control chamber, to control a communication area between the second control chamber and the discharge portion and a communication area between the second control chamber and a low pressure portion, in dependence on an oil temperature condition; and a control valve to be operated by a discharge pressure of the discharge portion and to decrease a pressure in the second control chamber when the discharge pressure of the discharge portion becomes higher than or equal to a predetermined pressure.

15. A variable displacement pump for an internal combustion engine, comprising:

a rotor adapted to be driven by the internal combustion engine;

a plurality of vanes slidably received in an outer circumference of the rotor;

a cam ring which surrounds the rotor and the vanes, which has a center line eccentric from a rotation axis of the rotor, which defines a plurality of operating oil chambers, and which is arranged to move to vary an eccentricity and thereby to vary a pumping volume;

an intake portion to open into the operating oil chambers in a volume increasing region in which volumes of the operating oil chambers are increased with rotation of the rotor;

a discharge portion to open into the operating oil chambers in a volume decreasing region in which the volumes of the operating oil chambers are decreased with rotation of the rotor;

an urging mechanism including first and second spring members arranged to apply an urging force to the cam ring in an eccentric direction with a spring force produced by the first and second springs, and to increase the urging force stepwise when the cam ring is rotated in a concentric direction from a maximum eccentric position and the eccentricity of the cam ring becomes smaller than or equal to a predetermined value;

a first control chamber arranged to receive oil discharged from the discharge portion and to apply a force to the cam ring in a direction decreasing the eccentricity;

a second control chamber arranged to receive the oil discharged from the discharge portion and to apply a force varying the eccentricity, to the cam ring;

a thermosensitive mechanism disposed in a passage connecting the discharge portion with the second control chamber and arranged to change over connection of the second control chamber between the discharge portion and a low pressure portion, in dependence on an oil temperature and to decrease the force applied to the cam ring in a direction decreasing the eccentricity when the oil temperature is high; and a control valve to be operated by a discharge pressure of the discharge portion and to increase the force applied to the cam ring in the direction decreasing the eccentricity by adjusting a pressure in the second control chamber when the discharge pressure of the discharge portion becomes higher than or equal to a predetermined pressure.

16. The variable displacement pump as recited in claim 15, wherein the control valve includes a spool which is slidable in a slide bore and which includes a first end portion including a pressure receiving surface receiving the pressure of the discharge portion, and a second end portion urged by an urging member and held in a low pressure state; the slide bore is formed with an opening of a first port connected with the second control chamber, an opening of a second port connected through the thermosensitive mechanism with the second control chamber; and the spool is configured to increase an opening area of the first port and decrease an opening area of the second port by moving against an urging force of the urging member.

17. The variable displacement pump as recited in claim 16, wherein the control valve is configured to close the opening of the second port when the opening of the first port is opened.

18. A variable displacement pump for an internal combustion engine, comprising:

a pump forming member arranged to vary volumes of a plurality of operating oil chambers by being driven by the internal combustion engine, to suck oil from an intake portion and to discharge the oil from a discharge portion;

a varying mechanism including a movable member to move to vary volume variation of the operating oil chambers opening to the discharge portion;

an urging mechanism including first and second spring members disposed in respective loaded states, and arranged to produce an urging force urging the movable member in a direction increasing the volume variation of the operating oil chambers opening in the discharge portion, and to increase the urging force stepwise when the volume variation is decreased to a value smaller than or equal to a predetermined value;

a first control chamber arranged to receive oil discharged from the discharge portion and to apply a force to the movable member in a direction decreasing the volume variation of the operating oil chambers opening in the discharge portion;

a second control chamber arranged to receive the oil discharged from the discharge portion and to apply, to the movable member, a force varying the volume variation of the operating oil chambers opening in the discharge portion;

a thermosensitive mechanism disposed in a passage connecting the discharge portion with the second control chamber, to control a communication area of a communication passage between the second control chamber and the discharge portion and a communication area of a communication passage between the second control chamber and a low pressure portion, in dependence on an oil temperature, and to decrease a force applied to the movable member in a direction decreasing the eccentricity in a high oil temperature state; and a control valve to be operated by a discharge pressure of the discharge portion and to adjust a pressure in the second control chamber and thereby to increase a force applied to the movable member in a direction decreasing the eccentricity when the discharge pressure of the discharge portion becomes higher than or equal to a predetermined pressure.

* * * * *